US005782583A

United States Patent [19]

Vales

[11] Patent Number: 5,782,583

[45] Date of Patent: Jul. 21, 1998

[54] IN-GROUND BARRIER

[75] Inventor: E. S. Vales, Waterloo, Canada

[73] Assignee: University of Waterloo, Waterloo, Canada

[21] Appl. No.: 360,626

[22] Filed: Dec. 21, 1994

Related U.S. Application Data

[63] Continuation-in-part of Ser. No. 765,254, Sep. 25, 1991, abandoned, which is a continuation of Ser. No. 487,260, Mar. 2, 1990, abandoned.

[30] Foreign Application Priority Data

Mar. 3, 1989 [GB] United Kingdom ..... 89 04845.8

[51] Int. Cl.[6] ..... E02D 5/08

[52] U.S. Cl. ..... 405/281; 405/278; 405/279

[58] Field of Search ..... 405/128, 129, 405/274–281

[56] References Cited

U.S. PATENT DOCUMENTS

| | | | |
|---|---|---|---|
| 697,943 | 4/1902 | Jackson . | |
| 824,513 | 6/1906 | Stevens | 405/279 |
| 826,801 | 7/1906 | Quimby . | |
| 836,725 | 11/1906 | Williams | 405/281 |
| 838,152 | 12/1906 | Williams . | |
| 879,792 | 2/1908 | Nye . | |
| 912,021 | 2/1909 | Neilson . | |
| 930,487 | 8/1909 | Marsh . | |
| 993,779 | 5/1911 | Johnston . | |
| 1,007,718 | 11/1911 | McGill . | |
| 1,175,168 | 3/1916 | Moulton . | |
| 1,176,294 | 3/1916 | Hill . | |
| 1,894,012 | 1/1933 | Wemlinger . | |
| 1,937,758 | 12/1933 | Harris | 405/279 |
| 2,054,203 | 9/1936 | Magee . | |
| 2,099,542 | 11/1937 | Stevens . | |
| 3,245,222 | 4/1966 | Galaup . | |
| 3,302,412 | 2/1967 | Hunsucker | 405/278 |

(List continued on next page.)

FOREIGN PATENT DOCUMENTS

| | | |
|---|---|---|
| 129275 | 12/1984 | European Pat. Off. . |
| 286068 | 10/1988 | European Pat. Off. . |
| 446471 | 7/1927 | Germany . |
| 2714974 | 10/1978 | Germany . |
| 12424 | 2/1981 | Japan . |
| 111717 | 9/1981 | Japan . |
| 131711 | 10/1981 | Japan . |
| 205615 | 12/1982 | Japan . |
| 280122 | 10/1989 | Japan . |
| 8300596 | 9/1984 | Netherlands . |
| 8600898 | 11/1987 | Netherlands . |
| 208022 | 12/1923 | United Kingdom . |
| 417773 | 10/1934 | United Kingdom . |
| 428398 | 5/1935 | United Kingdom . |
| 518727 | 3/1940 | United Kingdom . |
| 640335 | 7/1950 | United Kingdom . |
| 730835 | 6/1955 | United Kingdom . |
| 913328 | 12/1962 | United Kingdom . |
| 1090597 | 11/1967 | United Kingdom . |
| 1301320 | 12/1972 | United Kingdom . |
| 1427060 | 3/1976 | United Kingdom . |
| 1602597 | 12/1976 | United Kingdom . |
| 5532 | 9/1986 | WIPO . |

*Primary Examiner*—John A. Ricci
*Attorney, Agent, or Firm*—Anthony Asquith & Co.

[57] ABSTRACT

The barrier is waterproof, and is used to contain contaminated groundwater within an enclosure. Steel elements are pile driven, the elements having rolled-over forms (5,6) which inter-engage. Upon inter-engagement, an enclosed cavity (90) is created which extends from top to bottom of the piled elements. A scraper (19) on the junior element (8) cleans dirt out of the cavity as the junior is driven down alongside the adjacent senior element (7). The cavity may be cleaned out by inserting a hose pipe to the bottom of the cavity (90) and flushing through with water. Then, a sealant is injected into the cavity, using an injection tube. The inter-engagement of the edge forms (5,6) of the elements is such that the cavity formed by the inter-engagement is constrained to its nominal size and shape throughout the whole height of the barrier.

14 Claims, 15 Drawing Sheets

U.S. PATENT DOCUMENTS

| | | | |
|---|---|---|---|
| 3,333,431 | 8/1967 | Dougherty . | |
| 4,367,057 | 1/1983 | Hughes et al. | 405/267 |
| 4,453,366 | 6/1984 | Piccagli | 52/742 |
| 4,484,835 | 11/1984 | Van Klinken | 405/52 |
| 4,519,729 | 5/1985 | Clarke et al. | 405/258 |
| 4,607,981 | 8/1986 | Van Klinken | 405/52 |
| 4,671,705 | 6/1987 | Nussbaumer et al. | 405/267 |
| 4,741,644 | 5/1988 | Cavalli et al. | 405/50 |
| 4,808,039 | 2/1989 | Fischer | 405/281 |
| 4,981,540 | 1/1991 | Prochhorst | 156/157 |
| 5,066,353 | 11/1991 | Bourdo | 156/300 |
| 5,106,233 | 4/1992 | Breaux | 405/128 |

IN-GROUND BARRIER

This application is a continuation-in-part of application Ser. No. 07/765,254, filed Sep. 25, 1991, now abandoned, which is a continuation of application Ser. No. 07/487,260, filed Mar. 2, 1990, now abandoned.

This invention relates to the provision of a barrier that comprises pile-driven elements.

BACKGROUND TO THE INVENTION

It is a well established practice to provide interlocking elements that may be pile-driven into the ground, for example along a river bank, to prevent the bank from crumbling, and collapsing into the river.

The elements of these conventional barriers comprise lengths of steel sheet material, the cross-sectional shape of which is produced by rolling the sheet between rollers. The cross-sectional shape of the element generally includes changes of plane, so that the element is resistant against buckling. The cross-sectional shape is generally also provided, along the edges of the element, with hook-like formations, whereby the element may interlock with adjacent elements.

Such barriers have not hitherto been waterproof, in that the hook-like formations have permitted a leakage flow of water to take place through the assembled barrier. Previous proposals for designing waterproof barriers are shown in EP-0129275 (CORTLEVER, 27-Dec.-84); GB-1301320 (NEDERHORST, 29-Dec.-72); and GB-0518727 (DALRYMPLE-HAY, 6-May-40). Other relevant publications from the art of pile-driven barriers include WO-86/05532 (PROFILAFROID, 25-Sep.-86); GB-1427060 (SOLVAY, 3-May-76); GB-0640335 (WILLIAMSON, 19-Jul.-50-); and GB-0208022 (KOHLER, 13-Dec.-23).

The above designs have not proved efficacious from the standpoint of watertightness, primarily on the ground of reliability of the seal, and also cost. If a spill of a groundwater contaminant is made, and if it is determined that the spill must be contained behind a waterproof barrier, the expense can be enormous. Often, a barrier will comprise four plane walls, joined at the corners to make a rectangle, and thus the barrier will surround the zone of pollution, and fence it in. Sometimes, the barrier may not need to form a complete enclosure around the contaminant—where, for example, the requirement may simply be to divert a flow of polluted groundwater away from a well.

The invention is aimed at providing a barrier which can be rendered reliably waterproof in a less expensive manner than has been possible hitherto, from the standpoints both of materials cost and of installation cost, yet which is reliable and effective.

Apart from low cost, other aims of the invention are as follows: to reduce the disturbance of land during installation; to reduce shifting of the soil, which might be damaging to surrounding buildings; to reduce installation time; and to reduce the amount of heavy construction equipment needed.

It is recognized that it is not practicable to apply a sealing material to the element, prior to the element being driven into the ground. Even if the act of pile-driving the element does not actually damage the sealing material, the risk of such damage is high, and the engineer would not dare to take the chance since the cost of repairing a leaky barrier can be enormous. On the other hand, it has been perceived as very difficult to apply a sealant to the joints between elements once the elements have been driven into the ground.

BASIC FEATURES OF THE INVENTION

The elements of the barrier are provided with interlocking and inter-engaging edge forms. In the invention, these edge forms are so arranged that when the elements have been driven into place, the fact of the inter-engagement causes a cavity to be created, being a cavity that leads down from the ground surface to the bottom of the element. In the invention, the soil or other material that enters this cavity when the elements are driven into the ground may be flushed out by means of a hose or pipe inserted into the cavity, and the cavity may then be filled with sealant material.

The edge forms are so arranged that, when sealant is injected into the cavity, any potential leak paths running through the barrier from front to back are sealed off by means of the sealant. To this end, the design of the edge forms is such that the mouth of each leak path opens into the cavity, so that sealant present in the cavity may enter, and seal off, each leak path.

Consequently, the material that encircles the cavity must come from both elements, ie: in the invention, the circumference of the enclosure defining the cavity cannot be formed entirely from the material of one element, but rather the two inter-engaging elements each must supply a portion of the material of the composite circumference of the cavity.

It is recognized in the invention that the cavity must remain the same shape and size during and after driving. If the cavity were to close up, it would not be possible to insert the flush-out hose, nor to insert the sealant injection tube. Similarly, if the cavity were to open out, either the cavity might fill with soil, or the sealant might not be able to completely fill the cavity.

A dovetail means is therefore provided for constraining the cavity to a uniform size and shape. Preferably, the dovertail means is created simply by virtue of the manner in which the edge forms inter-engage, so that the dovetail means costs substantially nothing.

In the prior art, when a waterproof barrier has been needed, it has been known to excavate a trench, and to fill the trench with, for example, a soil-clay slurry. The sheet piling elements are driven down into the through this slurry, and the slurry then acts as the waterproof seal.

The invention is aimed at making it possible to achieve a corresponding reliability of watertightness, without the necessity for such measures as prior excavation. In the invention, the intention is that the piling elements may be reliably sealed, even though driven down into earth material that has not previously been excavated.

The inter-engagement of the edge forms, as described, has the effect not only that the barrier may easily be rendered leakproof; it is recognised also that the inter-engagement may be just as readily usable in a barrier that has no need to be made leakproof. Furthermore, it is possible, with most embodiments of the barrier of the invention, to make a non-leakproof barrier leakproof at a later date, especially if precautions are taken to keep the cavities open.

The junior edge form may be provided at its foot with a scraper. As stated, one portion of the composite circumference of the cavity is formed by the senior edge form, and the remainder of the circumference is formed by the junior edge form; each edge from therefore itself does not form a complete enclosure, but must include a respective gap. In the invention, dirt and soil present inside the senior edge form, after driving, is deflected out of the gap in the senior edge form by the scraper at the foot of the junior edge form.

DETAILED DESCRIPTION OF PREFERRED EMBODIMENT

By way of further explanation of the invention, an exemplary embodiment of the invention will now be described with reference to the accompanying drawings, in which.

The barriers shown in the accompanying drawings and described below are merely examples. It should be noted that the scope of the invention is defined by the accompanying claims, and not necessarily by specific features of exemplary embodiments.

Figure 1:
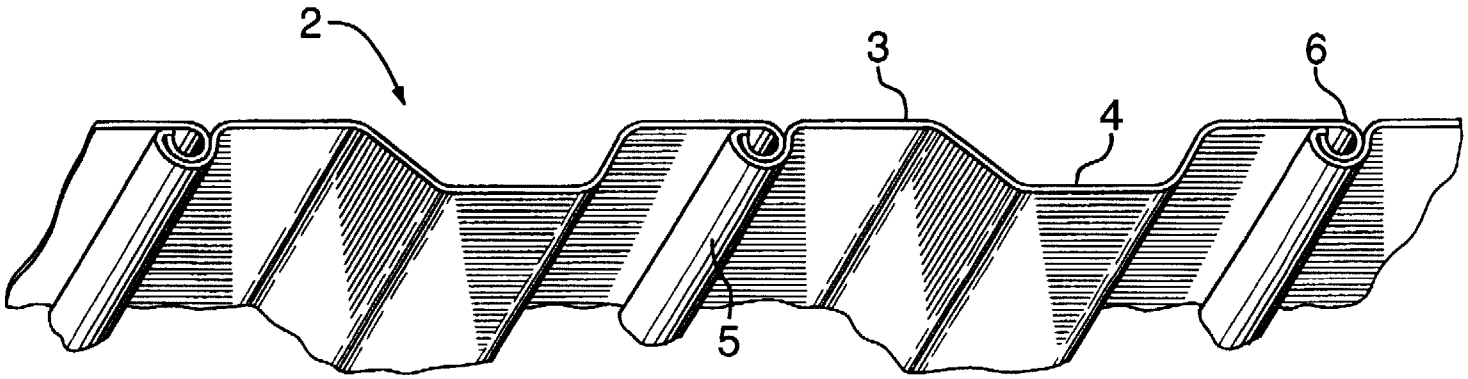
FIG. 1 shows a portion of a waterproof barrier which embodies the invention.

A barrier 2 comprises many sheet piling elements 3, some of which are shown in FIG. 1. Each element comprises a length of sheet steel of uniform cross-sectional shape. The conventional method by which such strips are manufactured is by a rolling operation, wherein the strips are passed between a series of rollers to produce the desired finished cross-sectional shape; and this conventional method may be employed also in the invention, to produce the required edge forms.

All the elements 3 have the same cross-section, which includes a central portion 4, in which the steel is somewhat angled to provide resistance to buckling while the element is being hammered into the ground, and to resist sideways distortion in the event that a pressure differential develops across the barrier.

The cross-section of the element also includes left and right edge forms 5,6.

Figure 2:
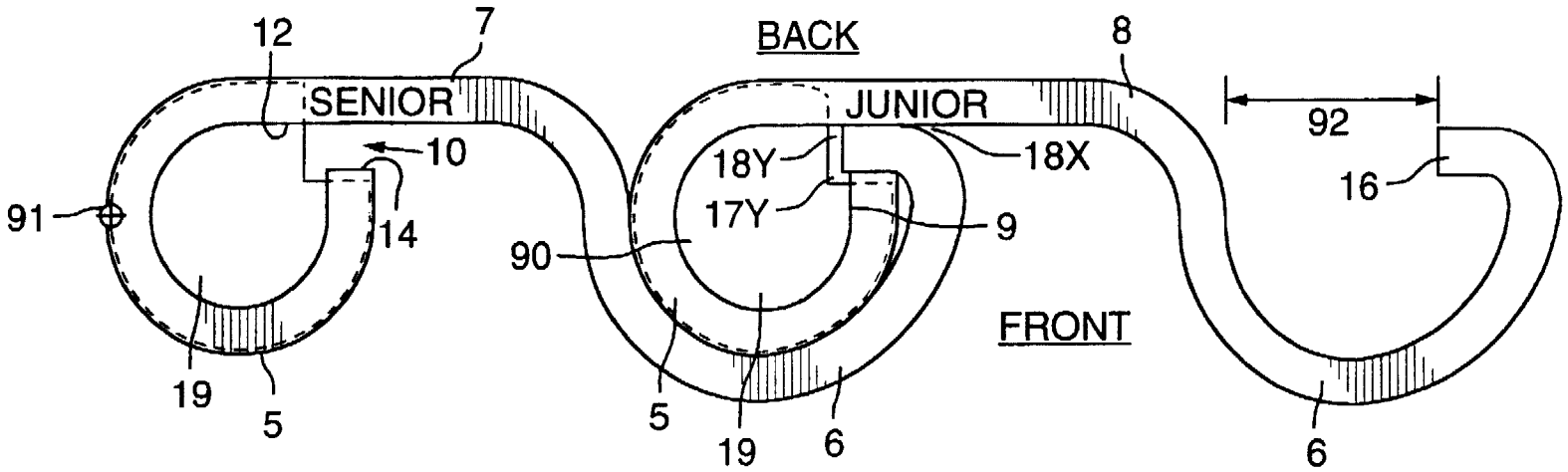
FIG. 2 is a plan view showing the inter-engagement of two elements of the barrier of FIG. 1.

FIG. 2 shows a close-up view of the left, or junior, edge form 5 of an element 8 of the barrier, together with the right, or senior, edge form 6 of an element 7 of the barrier. The left edge form 5 is such as to form almost a complete enclosure or encirclement. The left edge form 5 is not quite a complete enclosure however, in that a gap 10 is left between the end face 14 of the edge form 5, and the facing surface 12.

The gap 10 is filled, thus finally completing the encirclement 9, by a tag 16 provided as part of the right edge form 6. In fact, the gap 10 is smaller than the thickness of the material of the tag 16, so that the left edge form 5 tightly grips the tag 16 and thus the right edge form 6, during assembly of the elements, and afterwards.

As may be seen from FIG. 2, a potential leak path exists, by which fluid on the front side of the barrier might leak through to the back side of the barrier. This potential leak path may be regarded as divided into two components: a back leak path 17, having an entry mouth 17Y and an exit mouth 17X; and a front leak path 18, having an entry mouth 18Y and an exit mouth 18X. (The entry mouth of a leak path is that mouth of the leak path that opens into the enclosure.)

The entry mouths 17Y,18Y of the front and back leak paths 17,18 are spaced apart circumferentially around the enclosure 9. The distance of the spacing, as may be seen from FIG. 2, is equal to the thickness of the tag 16.

When installing the barrier, the elements are hammered downwards one after another, by a pile-driver. The senior and junior elements are so termed because the senior is driven in before the junior. In driving the piles of the invention, the conventional practice may be followed, of driving all the elements in the barrier in gradual progressive sequence, a little at a time.

When the senior element 7 has been fully driven, the space inside the right edge form 6 (which is to be occupied by the left edge form 5 of the junior element) would be now full of soil or gravel, and whenever other constituents are present in the ground, if precautions were not taken.

Figure 3:
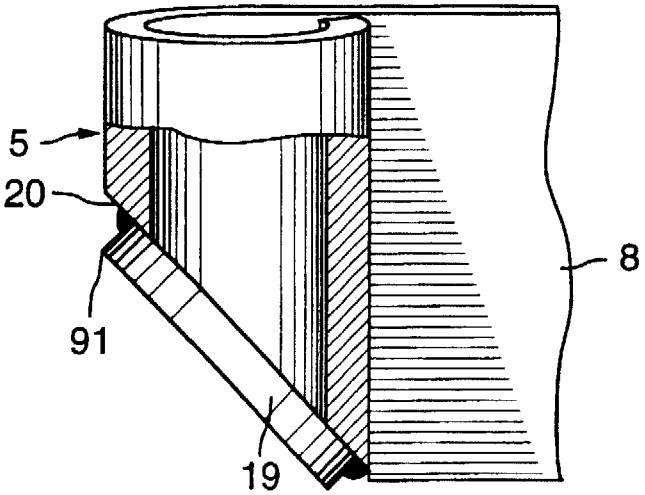
FIG. 3 is a side view of the foot of one of the elements shown in FIG. 2.

The left edge form of the junior element 8 is provided at its foot with a scraper 19, the purpose of which is to sweep the soil etc from the inside of the right edge form 6 of the senior element 7. FIG. 3 shows the foot of the left edge of the junior element 8. The left edge form 5 has been cut away at an angle, and the scraper 19 is welded in place onto the sloping face 20. The dashed (hidden) lines in FIG. 2 indicate the outline of the scraper 19. (Similar dot-dash lines in the other drawings indicate corresponding scrapers.)

To install the barrier, the right edge form 6 of the senior element 7 is engaged with the left edge form 5 of the junior element 8, and driving commences. As the junior element 8 is driven downwards, the scraper 19 sweeps the soil out from inside the right edge form 6 of the senior element 7. The cleaned-out space thus created then is occupied by the left edge form 5 of the junior element 8.

When both the senior 7 and junior 8 elements have been installed, the circumference of the encirclement or enclosure 9 is complete, and the cavity 90 inside the enclosure is substantially cleaned out.

The cavity 90 is to be filled with sealant. Before the sealant material can be inserted into the cavity, the cavity should be cleaned out. Accordingly, the next stage is that a hose or pipe is passed into the cavity 90, and a jet of water is used to flush any remaining soil particles out of the cavity. The hose or pipe should therefore be substantially smaller than the cavity, to allow the dirt particles to travel past the hose, and out of the cavity. The scraper 19 of course cannot be expected to sweep the space within the senior edge form 5 completely clean; but it is recognised that any particles not removed by the scraper will be small enough to be removed without trouble by the hosing operation.

The space within the cavity, around the hose, should not be too large, because the particles are being removed by the upward velocity of the escaping water, and the particles might settle if that velocity were small.

When the hose has been passed right to the bottom of the cavity 90, and when the water escaping from the top of the cavity is running responsibly clean, the flushing operation is complete, and the hose may be removed from the cavity, leaving the cavity full of clear water. (It is sometimes advantageous to reverse the action of the hose, ie to pour water into the cavity around the hose pipe, and to draw the water out of the cavity up through the hose pipe.)

Next, a tube for the injection of sealant is inserted into the cavity 90. When the tube has reached right to the bottom of the cavity, sealant injection commences, and the tube is withdrawn progressively up the cavity as the sealant fills the space below.

It is contemplated that the flushing hose and the injection tube might be inserted into the cavity at the same time. Thus the sealant would be injected from the mouth of the injection tube: the mouth of the flushing hose would be above the mouth of the injection tube, and water would be flushed therefrom in such a manner as to keep the annulus around the tube clear, as the two are gradually drawn up to the surface.

The speed at which the sealant injection tube is withdrawn is important: if the tube is withdrawn too quickly, not enough sealant will be left in the cavity, and the barrier may leak; if the tube is withdrawn too slowly, sealant may start to enter the space above the bottom of the injection tube, thus preventing the water in the cavity from escaping, and perhaps trapping water bubbles within the sealant.

The kind of barrier with which the invention is concerned may be required to remain sealed for centuries, and it is important that the integrity of the seal is assured. Once sealant has been placed in the cavity 90, it would generally be very difficult and expensive to replace it.

On the other hand, depending on the degree of security required, the nature of the contaminant, and other parameters, it may be preferred to use a sealant of the type that can be replaced, and to institute a policy of replacing the seal periodically.

The purpose of the sealant material is to fill the cavity 90 within the enclosure 9, and then to penetrate and seal off the leak paths 17,18. At the time when it is penetrating the leak paths, the sealant needs to be under pressure, to force it into the tight, narrow, leak paths. To obtain the required pressure, the sealant material may be injected under pressure, or the sealant material may be of the kind that expands upon coming into contact with water.

Some sealant materials swell (slowly) when saturated with water: these are easy to inject properly, because the sealant material remains substantially loose in the cavity for some time after the injection tube has been withdrawn. Later, the material swells, and penetrates the potential leak paths. One problem with the use of water-expanding materials is that there is not much water available in the cavity 90.

Other materials expand immediately upon leaving the end of the injection tube, and these require much more care during injection.

Some sealant materials are in the form of two or more components, which, when mixed, produce a foam. These materials, though expensive, are useful in the invention, especially if the foaming reaction time can be delayed long enough for the injection tube to be out of the cavity before foaming starts.

In selecting the type of sealant, the designer should assess the following aspects of performance: that the sealant is capable of penetrating into the potential leak paths; that the sealant will expand after emplacement; that the sealant has a low permeability to water; and usually that the sealant will bond readily to the steel of the pile elements.

The size of the cavity 90 is important. First, the cavity must be large enough to accept the flushing hose and the injection tube. Typically, the hose and tube will be of nominally half-inch (12.7 mm) internal diameter, such tubing being typically 18 mm outside diameter. The inscribed circle 21 (shown as a dotted line in FIG. 2) inside the cavity 90 therefore should be at least 18 mm diameter, and preferably should be a margin of tolerance greater than that.

In fact, the size of the cavity 90 should be larger still, to allow fluids inside the cavity easily to flow upwards and out of the cavity when the hose pipe is in place down the cavity. Preferably, the cross-sectional area of the cavity available for upward flow, ie the cross-sectional area of the cavity minus the cross-sectional area occupied by the hose, should be at least as great as the cross-sectional area of the bore of the hose.

Thus, a half-inch bore has a cross-sectional area of 127 sq mm, and its outer diameter occupies a cross-sectional area of 255 sq mm. Therefore, the cavity 90 should have a cross-sectional area of 382 sq mm, or more, if it is to properly accommodate a half-inch hose.

On the other hand, the cross-sectional area of the cavity 90 should not be too large. If the cavity were large in relation to the hose, water from the hose would flow only slowly up the cavity, which might hinder the effectiveness of the flushing operation. Also, the larger the cavity, the more (expensive) sealant is needed to fill it.

Thus, the preferred upper limit on the cross-sectional area of the cavity would be around 450 or 500 sq mm. for a half-inch hose. The cross-sectional shape of the enclosure need not be circular, and a perusal of the drawings will show that the enclosure in fact is not circular.

When the cavity has been correctly sized to accommodate the flushing hose, it may be found that the cavity is rather too large for the pipe through which the sealant material is to be injected. In this case, sealant emerging from the bottom of the pipe could easily flow upwards, into the annulus surrounding the sealant injection pipe. To prevent this, and to allow the injected sealant to be placed under pressure, a collar may be fitted to the bottom of the injection pipe, which fills or almost fills the cavity 90.

If the hose and tube were smaller than the half-inch size mentioned, the edge forms 5,6 of the elements would also have to be smaller, ie the edge forms would have to be bent into tighter shapes. The operation of rolling the material into tighter curves would not be so practicable, especially when the elements are of thicker steel.

The thicker materials are used in pile-driven barriers which have to be driven deeper, or which have to sustain large side-thrusts, for example when the barrier is used to prevent a river bank from collapsing. Pile-driven barriers have not generally been used for the purpose simply of sealing off an area of contaminated ground, where there is no real requirement for side-thrust capability. It may therefore be in some cases that the elements for a water-proof barrier may be of a thinner steel than has been required for conventional side-thrust-supporting barriers. In those cases, the edge forms may be bent to more intricate shapes, and smaller hoses and tubes may be used.

On the other hand again, the elements do have to be pile-driven into the ground, and the elements must be robust enough to stand up to the driving treatment. This aspect indicates that although a thinner element may be theoretically possible in some cases from the standpoint of supporting only light side-thrusts when installed, the thinner element cannot after all be permitted, because of the reduced drive-ability of the thin element, especially if the ground contains cobbles or other non-homogeneities that might interfere with the driving operation. In this case, insofar as hose size is dictated by the thickness, and hence the bend-ability, of the steel, it will probably be found that the dimensions adapted for half-inch hose once again would apply.

In other words, the flushing hose and injection tube will generally be of the half-inch size, for operational reasons, and it is recognized that the conventional range of thicknesses of steel from which pile-driven elements are made can be readily bent to the tightness required to accommodate the half-inch size. It is not an essential feature of the invention, however, that the hose be of the said nominal half-inch size.

It is important that the mechanical shape and size of the enclosure 9 be maintained accurately throughout the driving operation; and later, in service.

It may be noted from a perusal of FIG. 2 that the junior 8 and senior 7 elements are locked against movement relative to each other, both in the left/right sense, and in the front/back sense. It is important, in the invention, that this degree of constraint, even if the actual shapes of the edge forms are not those shown in FIG. 2, be always present. If the elements were allowed to move relative to each other during driving, such that the encirclement or enclosure 9 might become larger or smaller, the integrity of the seal between the elements could not be relied on.

When the edge forms are as shown at 5,6 in FIG. 2, the overlapping and interlocking interaction of the senior 7 and junior 8 elements, which leads to the creation of the encirclement or enclosure 9, also provides the required degree of guiding constraint between the elements to guarantee that the enclosure 9 remains always of the same shape and size.

Figure 4:
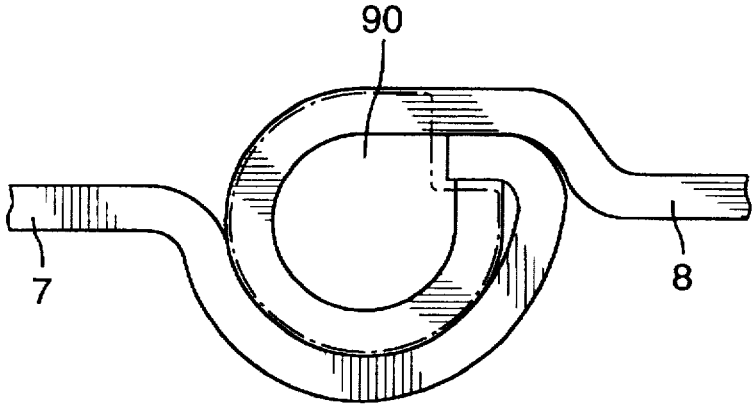
FIG. 4 is a plan view showing the inter-engagement of two elements of another barrier which embodies the invention.
Figure 5:
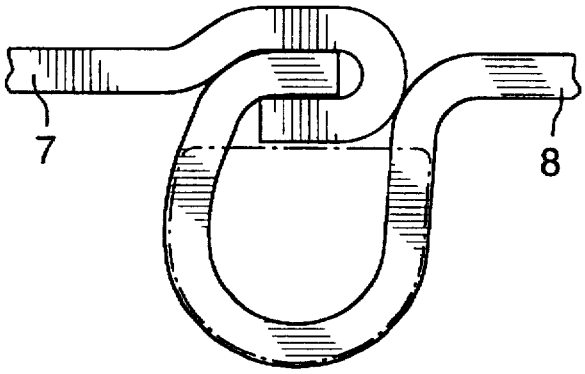
FIG. 5 is a plan view showing the inter-engagement of two elements of another barrier which embodies the invention.

The arrangement of FIG. 4 is an example of an arrangement that is equivalent to that of FIG. 2, for the purposes of the invention. The double bend, though more difficult to roll, adds worthwile strength and robustness to the element.

However, it is not essential that the part of the interlocking structure that produces the guiding constraint, and the part of the interlocking structure that produces the enclosure, should be one and the same.

Figure 6:
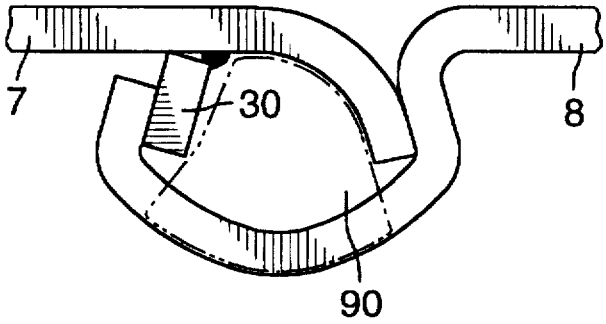
FIG. 6 is a plan view showing the inter-engagement of two elements of another barrier which embodies the invention.
Figure 7:
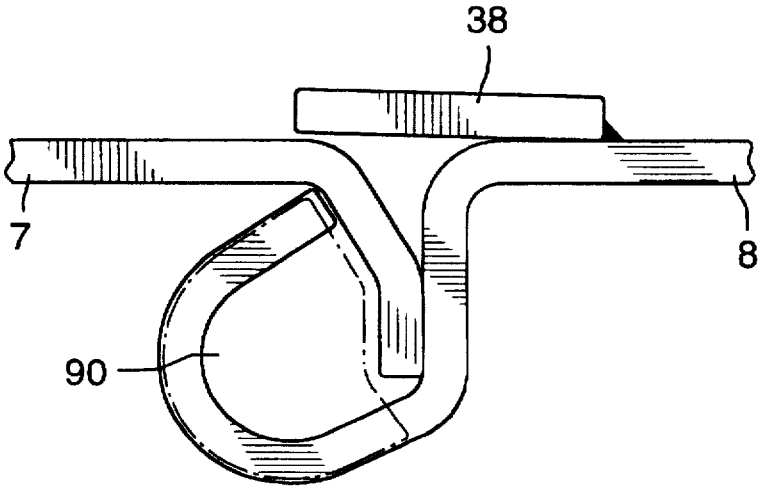
FIG. 7 is a plan view showing the inter-engagement of two elements of another barrier which embodies the invention.

The addition of a welded-on guide bar of course increases the cost of the element, but in some cases the extra expense may be more than recouped in the increased flexibility in the design of the enclosure. Ways in which a welded-on bar may be used are illustrated in FIGS. 6 and 7. The guide bar 30,38 need only be tacked onto the element at such intervals as will give adequate mechanical strength; the guide bar needed not be itself sealed to the element.

Figure 8:
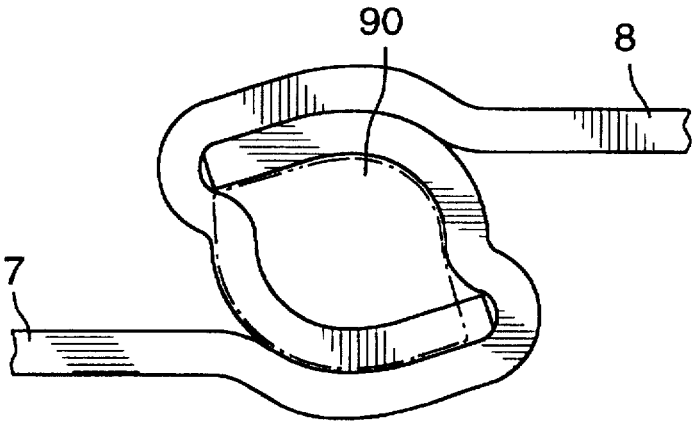
FIG. 8 is a plan view showing the inter-engagement of two elements of another barrier which embodies the invention.

When the edge forms of the elements are arranged as in FIG. 8, for example, the elements are so guided as to prevent relative movement in the front/back sense, and in the left/right sense. In FIG. 8, as indeed in the rest of the drawings (apart from FIG. 9), the elements cannot move relatively, neither so as to open the cavity 90, nor so as to close the cavity.

Figure 9:
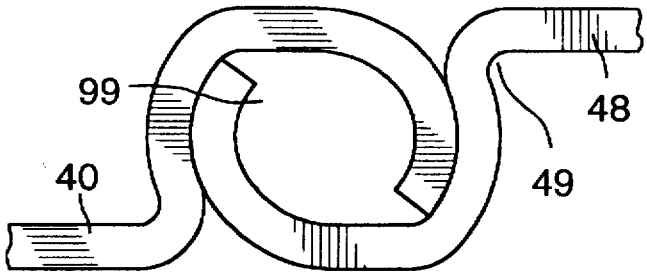
FIG. 9 is a plan view showing the inter-engagement of two elements of a barrier which does not embody the invention, but which is included for illustrative purposes.

In the example shown in FIG. 9, on the other hand, it will be noted that a mode of relative movement between the elements 40,48 has been permitted, which could lead to the cavity 99 becoming smaller. Therefore, the arrangement of FIG. 9 is outside the invention.

Another problem with the FIG. 9 arrangement, apart from the fact that the elements are not properly guided relatively, lies in the fact that the edge form includes a re-entrant bend, at 49. Such a formation can make it difficult, during rolling, for the element to release from the rollers, and adds greatly to the expenses of manufacture. The tighter the bend 49, the more this problem arises.

Figure 10:
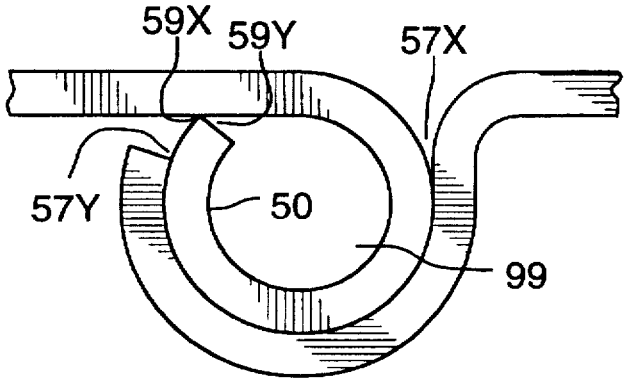
FIG. 10 is a plan view showing the inter-engagement of two elements of another barrier which does not embody the invention, but which is included for illustrative purposes.

It is recognized in the invention that the encirclement or enclosure should not be provided entirely in one of the elements, but instead the encirclement should not be complete until both elements are brought together. Thus the arrangement should in FIG. 10 is outside the invention, because the encirclement 50 is, in substance, complete without the presence of the senior element 56. It will be observed that in FIG. 10 a leak path 57X,57Y exists, which does not communicate with the enclosure 50, and therefore this leak path will not be sealed by the sealant injected into the cavity 99. In the invention, the mouths of both the back leak path and of the front leak path open into the enclosure, so that both leak paths are accessible to sealant inserted into the cavity.

Figure 11:
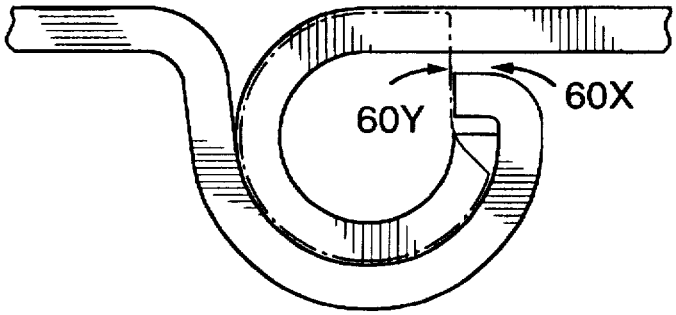
FIG. 11 is a plan view showing the inter-engagement of two elements of another barrier which embodies the invention.

In the arrangements described thus far, the leak paths have been the tight, narrow, tortuous paths that exist between two metal surfaces that are pressed together in directly contacting abutment. FIG. 11 shows an arrangement in which the front leak path 60X,60Y is wide open.

In the FIG. 11 example, when the sealant is injected into the cavity, the sealant will tend to dissipate itself through this wide open leak path 60. However, depending on the nature of the surrounding soil, the amount of dissipation of the sealant into the soil may be acceptable, and thus the FIG. 11 example should be regarded as being within the broad scope of the invention.

Particularly in cases where the soil material is coherent, and therefore the soil tends to contain the sealant, and the soil does not tend to crumble in through any gaps, the potential leak paths need not be so tight. Generally, though, in the invention, it is preferred that the leak paths be not wide open, but that the metal interfaces at the leak path be pressed directly together, tightly and resiliently.

Figure 12:
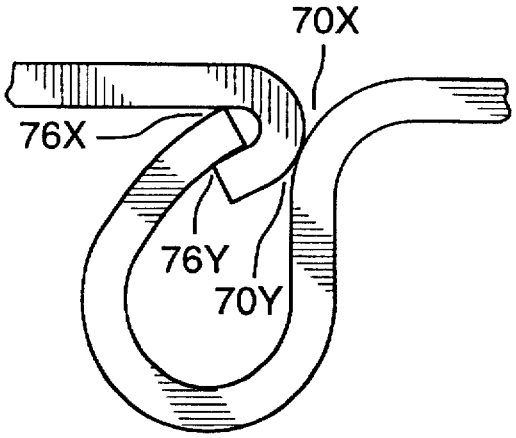
FIG. 12 is a plan view showing the inter-engagement of two elements of another barrier which embodies the invention.
Figure 13:
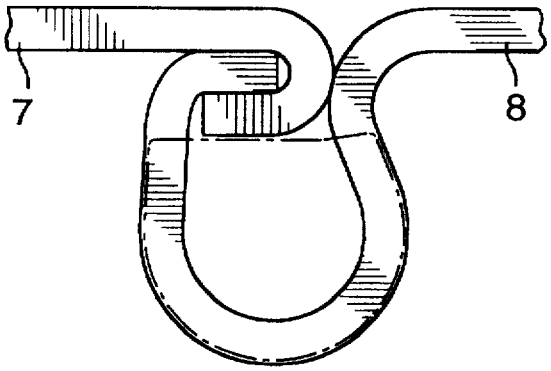
FIG. 13 is a plan view showing the inter-engagement of two elements of another barrier which embodies the invention.

It is also preferred that the metal surfaces at the interface be pressed together over a substantial length of engagement. In the arrangement of FIG. 12, for example, the metal surfaces only contact each other at a small point. The leak path 70X,70Y in that case is constituted by only a very short length of engagement, and it can happen that sealant might easily escape out through the gap, at any small flaw in the engaging surfaces. If that happens, a pressure might not develop in the sealant in the neighbourhood of such a gap, and this lack of available pressure would mar the reliability of the penetration of the sealant into the other leak path 76X,76Y.

Therefore, in the invention, it is preferred as a general rule that the/font and back leak paths should both be as tight, as long, and as resistant to the through-flow of sealant as possible, so that sealant pressure may be developed within the enclosure. The greater the pressure in the sealant, the greater the force available to squeeze the sealant into the nooks and crannies that inevitably exist at the interface between two pressed-together metal surfaces.

In many of the arrangements illustrated in the drawings, it does not matter which is the senior section, and which the junior. It should be noted that the scraper is attached to the junior section, and should be arranged so as to sweep out the soil etc that has accumulated inside the edge form of the senior element. In selecting which element is to be the senior, ie which element is to be driven first, it should be borne in mind that the opening in the edge form of the senior, through which the swept soil is to be ejected, should be wide open. It should also be noted that the scraper needs to be welded onto the bottom of the edge form over a substantial portion of the edge form, and not just over a small portion of the form.

In FIG. 2, for example, if the right element 8 were to be made the senior, and the left: element 7 the junior (ie if the element 8 were to be driven in first) the scraper would have to be welded to the edge form 6. Therefore, the scraper would have to be welded to the tag 16, since the tag 16 is the only portion of the now-junior edge form 6 that has access to the inside of the now-senior edge form 5. Equally, in that case, the soil etc contained inside the edge form 6 would have to be swept out through the relatively narrow space of the gap 10. Thus it is important in FIG. 2 that the senior/junior choice be as first described.

In the arrangement of e.g. FIG. 8, on the other hand, it makes little difference which element is the senior and which the junior. It is essential, though, that the scraper be attached to whichever of the edge forms is selected as the junior.

In the invention, as mentioned, it is essential that an enclosure or encirclement be created by the inter-engagement of adjoining elements; and it is essential that all potential leak paths from the front to the back of the barrier should communicate with this enclosure, so that, when sealant is injected into the enclosure, the sealant seals off the leak paths.

It is also essential that the elements be provided with a mechanical guiding and locating means whereby the adjoining elements are prevented from encroaching or separating with respect to each other. This ensures that the enclosures are maintained dimensionally constant over the whole engaged height of the elements.

However, whilst it is essential that a mechanical guiding and location means be provided, it is not essential that the bent and folded components of the edge formations should necessarily be the sole constituents of that means.

Figure 16:
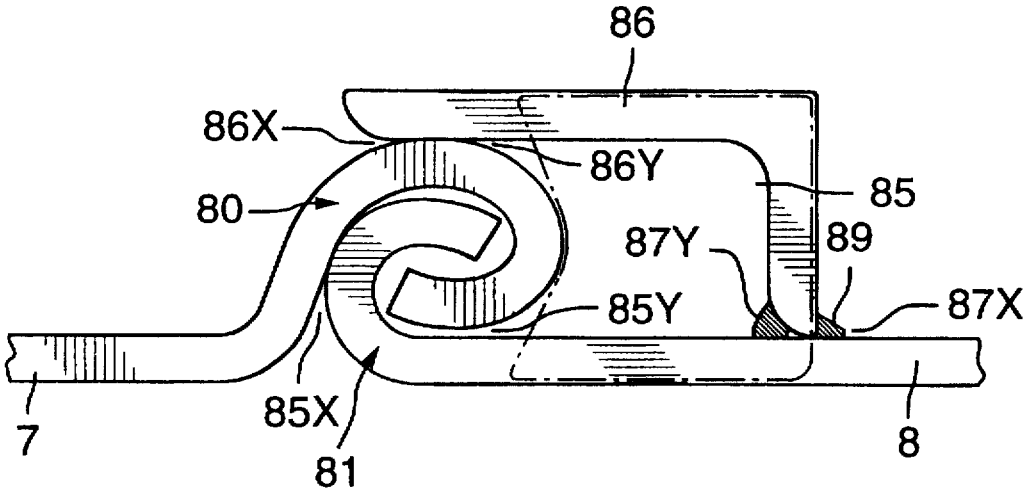
FIG. 16 is a plan view showing the inter-engagement of two elements of another barrier which embodies the invention.

FIG. 16 shows an arrangement wherein the rolled and bent edge forms 80,81 are simply hooks, which, when engaged together, serve to guide and locate the elements by preventing the elements 7,8 from encroaching or separating with respect to each other. The encirclement or enclosure 83, as required in the invention, in this case is completed by an added-on L-shaped steel section 84, which is welded to the element 8.

Figure 17:
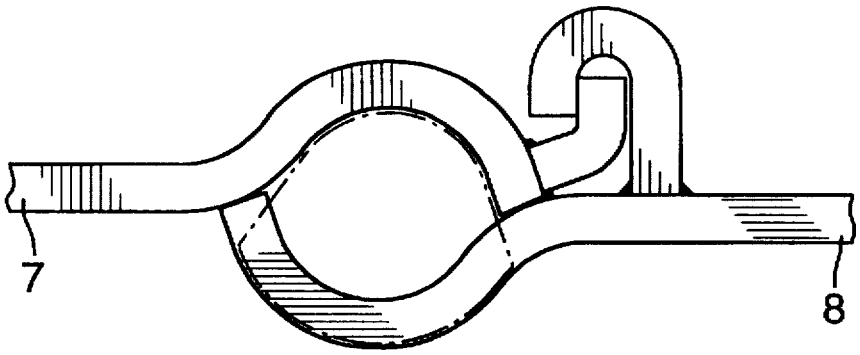
FIG. 17 is a plan view showing the inter-engagement of two elements of another barrier which embodies the invention.

In FIG. 16, the front leak path 85X,85Y is the tortuous path between the two hook shapes. There are two potential back leak paths, designated 86X,86Y and 87X,87Y. (The welding indicated at 89 is not continuous but is just tacked at intervals.) Sealant injected into the enclosure 83 is able to seal off all the potential leak paths, however.

in FIG. 16, the rolled and bent edge formations only comprise the mechanical guide means, not the enclosure. In FIG. 17, by contrast, the rolled and bent over edges comprise only the enclosure, not the mechanical guide means.

Figure 14:
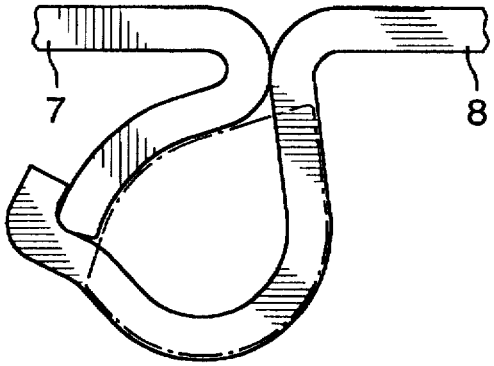
FIG. 14 is a plan view showing the inter-engagement of two elements of another barrier which embodies the invention.
Figure 15:
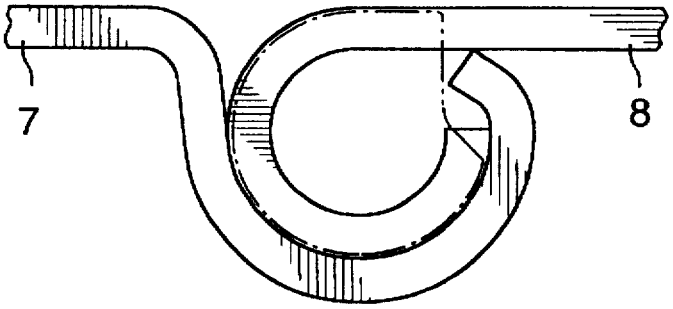
FIG. 15 is a plan view showing the inter-engagement of two elements of another barrier which embodies the invention.

In some barriers, it can be important that articulation of the elements can take place, for example when the containment zone created by the barrier has to follow a curved outline. Some of the embodiments shown in the drawings do not permit such articulation; FIG. 14, for example. In FIG. 12, on the other hand, several degrees of articulation movement could be accommodated, without the dimensions and shape of the enclosure becoming distorted. The manner in which the elements engage must be such that even if articulation does take place, the size and shape of the enclosure are not substantially affected thereby.

To lessen the resistance to articulation, the inter-engaging hooks, and other shapes as described, may be provided with more clearance or looseness than that indicated in the drawings.

The drawings (including those not specifically referred to) are presented so as to show many examples of shapes of the edge forms that may be employed in accordance with the invention. Some general principles may be noted in relation to the examples.

It is preferable that the senior edge form should have a large gap in its circumference, ie that the senior edge form should not constitute so much of the circumference of the final enclosure as to prevent the dirt from escaping. Any dirt swept out of the senior, by the scraper attached to the junior, passes out through whatever circumferential gap is present in the senior. It is preferable therefore that the circumference of the cavity 90 should be constituted not almost wholly by the senior but that a substantial portion of the circumference of the cavity should be constituted by the junior.

As regards the angle at which the scraper is set, it is important that the foot of the element should not be cut off at such an angle that corners of the web might be left that would be exposed and vulnerable to damage during piling. In FIG. 3, the slope of the cut is from left to right: the slope should not be from right to left in that view. The angle at which the scraper is set preferably should be such that the top of the scraper lies towards the centre of the circumferential gap in the senior, ie the gap through which the ejected dirt is to pass.

As may be seen from FIG. 3, the topmost point of the scraper is that marked 91 in FIG. 2, towards the extreme left of the edge form 5; the gap 92 in the right edge form 6, through which the scraped out dirt is to escape, however, faces the back (top in FIG. 2) of the barrier. It would be preferable if the topmost point 91 of the scraper were to be aligned exactly with the gap 92; but it is recognised that in fact exact alignment is not required. The topmost point on the scraper should not, however, be so far out of alignment as to be, for example, diametrically opposite the gap.

The scraper is of course vulnerable to being damaged during driving, being at the foot of the element. Therefore the scraper should be attached to the edge form 5 over as much of its circumference as possible. Thus in FIG. 2 the scraper is welded over at least ¾ of its circumference, which is very strong. The scrapers in FIGS. 4,5,7,11,12,13,15,16 are also good from this standpoint. The scrapers in FIGS. 6,8,14 are, however, less robustly attached.

It will generally always be preferable to have the topmost point on the scraper towards the left of the left edge form (with the left/right orientation as shown in the drawings). The angle of the cut-off or chamfer plane 20 as is shown in FIG. 3 is convenient to manufacture and leaves no vulnerable exposed ends which might be bent aside during driving. The restriction should be borne in mind, though, that if the topmost point of the scraper is at its extreme left, the gap in the senior edge form should not face directly towards the right. In almost all the drawings the gap in the senior edge form faces, at least to some extent, to the left. Only in FIG. 16 does the gap in the senior edge form face to the right; but in FIG. 16 the gap is so wide—being in fact approximately ¾ of the total circumference of the enclosure—that there will be little problem of the scraped dirt being deflected aside, whatever the angle of the scraper.

Another aspect to be considered in the layout of the edge forms is that of the circumferential length of each of the elements that is exposed to the sealant. Preferably, each element should have a long length exposed to the sealant, so that the sealant has a good opportunity to adhere to both elements.

In the case where the barrier is to fully encircle a contaminated area of ground, the final element of the barrier to be driven will have to engage with the edge forms of two other elements. It is an advantage in that case if the layout of the edge forms be chosen from the standpoint that the senior/junior roles be interchangeable.

It will be appreciated that an element is either senior or junior only in relation to its neighbours. In FIG. 2 the element 8 is junior to the element 7, but in turn the element 8 will be senior to the element (not shown) that will be placed immediately to its right. When the barrier forms a complete periphery, the last-inserted element will be junior to its adjacent neighbours both to the left and to the right.

It may be preferable in some barriers for the main elements of the barrier to be of thicker steel, and for these main elements to be joined by coupling elements of thinner steel. The thinner material can be more easily rolled to tightly-radiused shapes.

In some cases, it may be preferred that the barriers include a sharp bend. In that case, a piling element may be bent about a vertical axis, at the appropriate angle, for use at the bend. A rectangular encirclement may be achieved, for example, by setting four such elements, each with a right-angle bend, at the four corners.

It may be noted that the barrier of the invention, although designed for use as a sealable barrier, in fact may be used as an ordinary unsealed barrier, simply by omitting to inject sealant into the cavity 90. The enclosure is created simply by virtue of the shape in which the edge forms are rolled, and once the rollers exist for manufacturing those edge forms, the forms can be used universally.

If the barrier is not sealed, ie if sealant is not injected into the cavities 90 (as a matter of policy at the time of installing the barrier) the cavities 90 preferably should be protected. This can be done by plugging the tops of the cavities. Then, the option is available to change the policy later, to remove the plugs and to inject sealant.

In this specification, the terms "right" and "left" are used interchangeably, and are for definition purposes only. The terms, as used herein with reference to the edge-forms of the pile-driven elements of the barrier, should not be construed as being limited only to a particular manner of viewing the barrier. Thus, if a particular barrier is viewed first from the front, and then the same barrier is viewed from the rear, what was first a left edge-form becomes a right edge-form, and vice versa. In construing the scope of the accompanying claims, it is arbitrary whether the barrier is viewed from the front or from the back: but the manner of viewing the barrier should be consistent, either consistently from the back or consistently from the front.

It has been described that the sealant that is present in the cavity inside the enclosure is inserted into the cavity by means of an injection pipe. The injection pipe runs down into the cavity from above, ie from a sealant injection pump or the like located above ground.

Other means for sealing the cavity are also contemplated, as will now be described.

In cases where it is necessary to remove the elements from the ground, a problem can arise, when the sealant is of a very adhesive nature, that the sealant provides such a strong bond between the elements that the elements cannot later be separated and drawn out individually. In cases where the barrier is required to be withdrawable, therefore, the need arises for a manner of filling and sealing the cavity which does not permanently bond the elements together.

Figure 18:
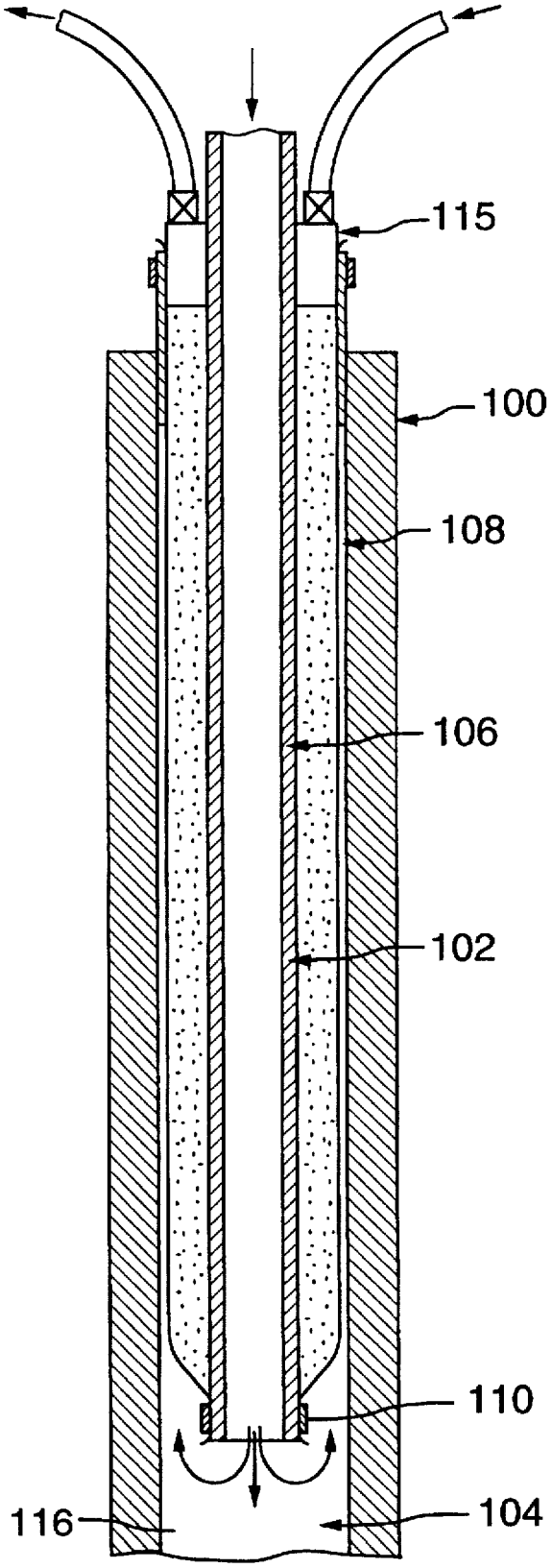
FIG. 18 is a cross-sectioned elevation of a cavity at a joint between elements.

FIG. 18 shows such a system, which is based on the use of an inflatable tube. After the enclosure 100 has been flushed out, and inspected and seen to be clear and open from top to bottom, an inflation unit 102 is lowered down into the cavity 104.

The inflation unit 102 comprises a core tube 106 of rigid pvc. A sleeve 108 of stretchable elastomeric material (eg neoprene rubber) is clamped at 110 to the bottom of the core tube, and extends upwards around the core tube. When the unit is being lowered into, or being raised out of, the cavity 104, the sleeve 108 is collapsed, and lies pressed around and against the core tube 106 by the pressure of water in the cavity. The overall diameter of the core tube and the collapsed sleeve is substantially smaller than the inscribed circle inside the enclosure 100, whereby the unit 102, when not inflated, can easily pass up and down inside the enclosure.

The upper end of the sleeve 108 is attached to a collar 115, through which water or other inflation liquid may be forced into the annular space between the sleeve 108 and the core tube 106, in order to inflate the sleeve. The sleeve is inflated after the unit 102 has been lowered down to its full depth inside the cavity 104.

Such an inflation unit has the limitation that the region 116 below the unit is left unsealed. A bed of bentonite, grout, or other sealant may be placed below the unit.

The bed of sealant may be inserted prior to the inflation unit being lowered into the cavity, or the sealant may be injected through the hollow centre of the core tube 106, after the inflation unit is in place (and indeed after the unit is inflated).

A problem that can arise when an inflation unit, as described, is used is that although the elastic sleeve will seal very well against the larger-radiused surfaces of the enclosure inside the cavity, the sleeve will not penetrate very tightly into the nooks and crannies of the enclosure. As a result, although the mouths of the leakpaths are well-sealed from each other (in the sense that water cannot travel laterally around the cross-sectional surface of the enclosure), it might turn out to be possible for water to leak vertically up and down the cavity. When deciding whether to specify an inflatable unit, the designer should have it mind whether this vertical leakage might constitute a problem.

The stretchy sleeve has little resistance to tearing, and therefore should not be allowed to rub against sharp edge etc. For instance, welding splashes on the inside of the enclosure 100, if such were present, would indicate against the use of an inflatable unit.

Another use of an inflatable unit can be made as follows. The inflatable unit may be placed part-way up the cavity, after the sealant injection hose has been lowered to the bottom of the cavity. The unit is inflated, end serves as a packer to seal off a lower region of the cavity. This enables a pressure to be established inside the lower region of the cavity, whereby the sealant may be injected under a higher pressure. The high injection pressure helps to ensure that the sealant penetrates the nooks and crannies of the cross-sectional shape of the enclosure.

Although suitable mainly for sealing temporary barriers, the inflation unit may be used on permanent barriers. As mentioned, the inflation unit may also be used a temporary packer, on permanent barriers, to enable the sealant to be injected under a high injection pressure.

Figure 19:
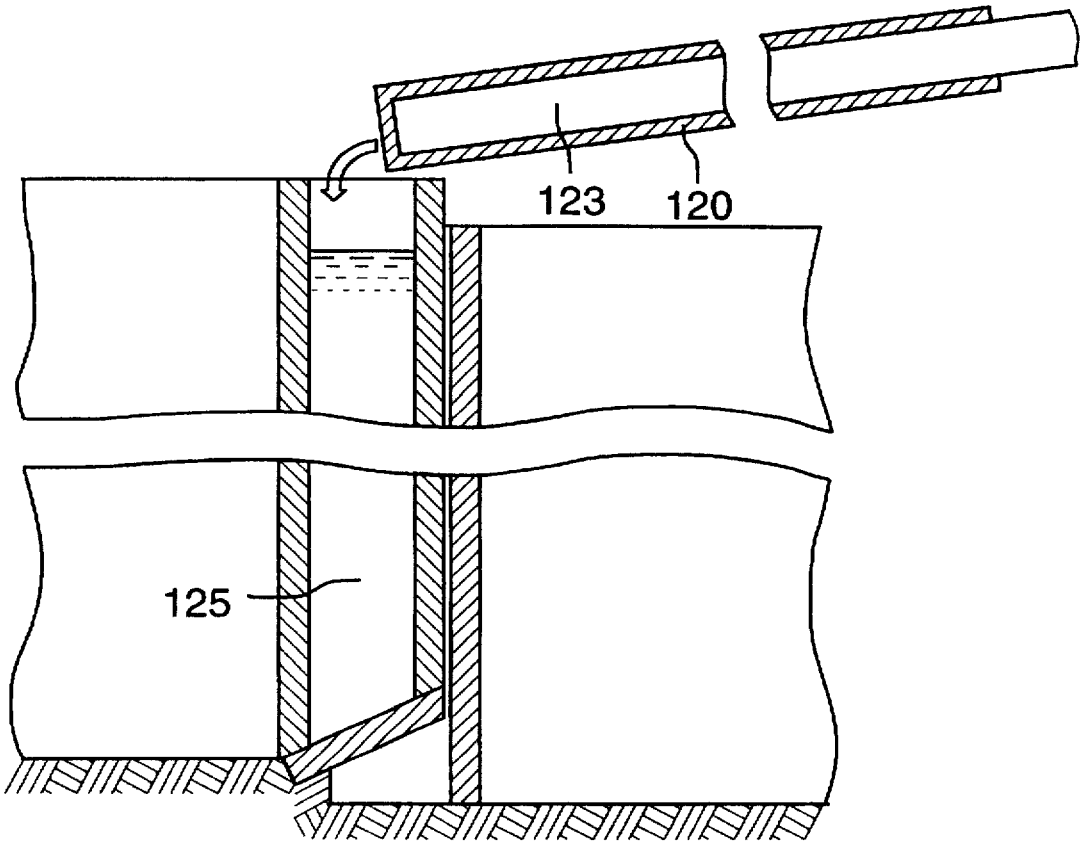
FIG. 19 is an elevation similar to that of FIG. 18, showing another joint between elements.

Another variation on the manner of inserting sealant in the cavity is shown in FIG. 19. Here, the sealant is applied as a coating 120 around a central core 123. The sealant in this case should be of the kind that swells alter installation in the cavity 125. The core, with the coating attached, is inserted while the sealant is in its un-swelled state; upon being wetted, the sealant expands to fill the cavity, and penetrates the nooks and crannies.

Like the other systems described, the sealant-on-a-stick system of FIG. 19 requires that the cavity 125 be flushed clear and open from top to bottom after installation of the barrier elements in the ground.

As mentioned, the flush-clean cavity should be of a substantial diameter, the inscribed circle being preferably at least 18 mm in diameter. When the cavity is of a large size, however, a good deal of sealant material is required to fill it. The cost of the sealant material then should be considered: cement grouts are usually cheap enough, but bentonite, and especially epoxy and two-part expanding foams and sealants, can be expensive in large volumes. In cases where the sealant being used is an expensive one, cost savings can be made by inserting a filler into the cavity.

Figure 20:
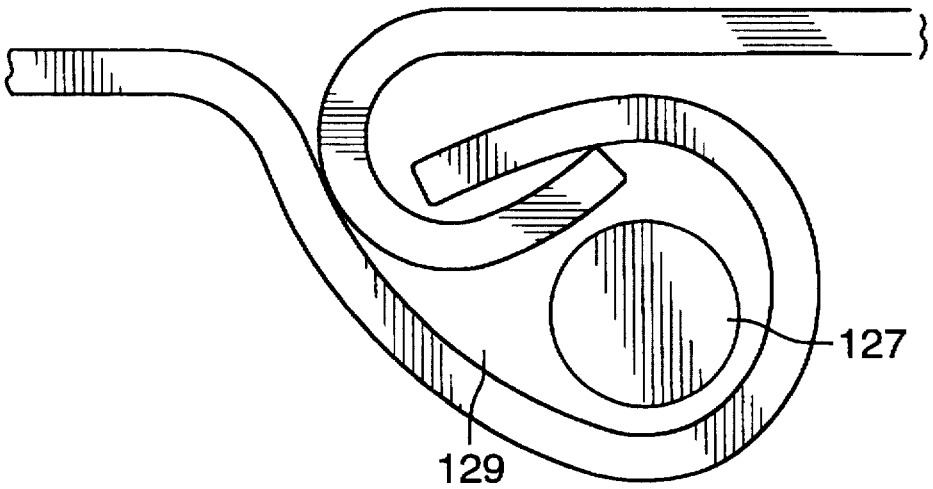
FIG. 20 is a plan view of an inter-engagement between two elements.

In order to save on the expense of the sealant, as shown in FIG. 20, after the cavity has been flushed out clean from top to bottom, a rod 127 of inexpensive filler material (such as plastic, or wood) is lowered down into the cavity 129. The rod occupies more or less the full height of the cavity. Sealant is then injected around the rod. The rod of course must leave enough space in the cavity to allow the sealant injection tube to be passed down the cavity.

Not only does the use of the filler rod 127 serve to economize on the costs of sealant, but the presence of the rod may assist in the curing of the sealant. Many sealants are of the type which do not cure properly (evenly) if present in a large bulk, and the rod serves to keep the in-cavity thickness of the sealant small, by keeping the bulk of the sealant out of the large centre of the cavity.

On the other hand, other sealants, including grouts, etc, perform better when present in a large bulk.

As described, the preferred manner in which dirt extracted and removed from the cavity is by flushing the cavity out with water fed from a hose pipe passed down inside the cavity. However, another way of cleaning out the cavity is by augering. Augering is suitable mainly for shallow barriers, and when the soil material is light sand. The cavity may be flushed out with water after augering.

Another manner in which the designer of the system might consider augering is that the augering facility may be provided on-site, but be saved as a last resort, ie reserved only for those occasions when a cavity has a blockage which cannot be cleared by flushing alone.

It is often the case that the pile-driving equipment available is powerful enough to be able to drive more than one element at a time. In such cases, it is economical to weld two (or more) elements together, edge to edge. However, it is economical only to tack-weld the edges, not to provide a continuous weld.

A tack-welded joint is not watertight, and therefore the joint requires to be made watertight after installation. Such a joint can be made watertight in a manner similar to that described above for use with the joints which involve the elements sliding relatively to each other during driving.

Figure 21:
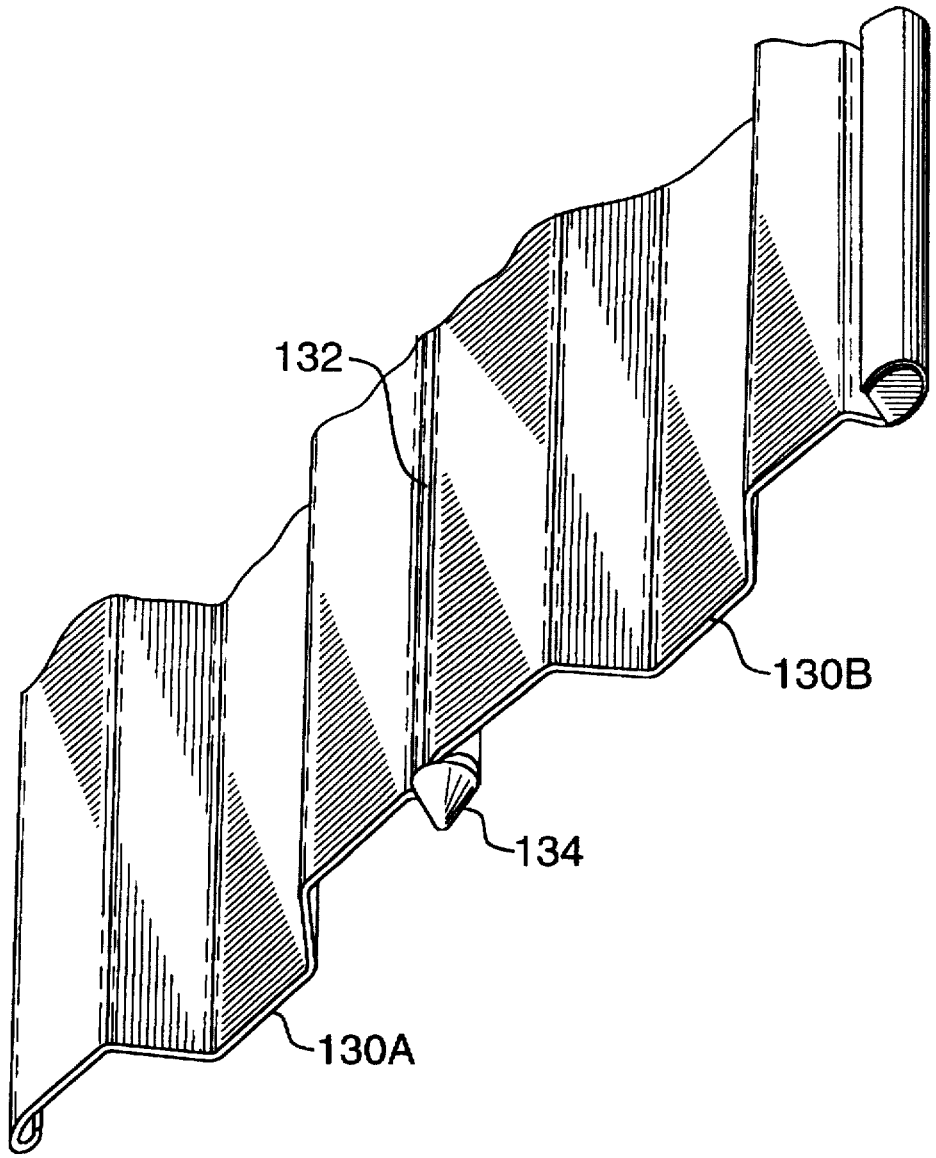
FIG. 21 is a pictorial view from underneath a composite element.

FIG. 21 shows a pair of elements 130A,130B that have been welded together. The edge-forms at the central welded joint 132 are the same as the edge-forms at the left and right edges of the composite (i.e double) drivable element. A cap 134 is welded to the edge-forms that make up the enclosure defining the cavity at the welded joint 132, underneath the cavity.

Now, when the composite or double drivable element is driven into the ground, no dirt can enter the cavity from below. Dirt particles can perhaps enter through the gaps or leakpaths in the profiles of the edge-forms, but such particles inevitably will be very small, and will be easily flushed out by running a hose down to the bottom of the cavity, after the composite element has been driven.

Thus, tack-welded joints between elements can be made watertight by the techniques as described herein, even though the joint is not continuously-welded.

As a general rule, as mentioned, a scraper-plate is welded to the foot of the junior edge-form, and, as mentioned, preferably the junior edge-form constitutes the major part of the total circumference of the enclosure. The junior being major results not only in adequate support all round for the welded-on scraper-plate, but means also that the circumferential gap in the senior, through which the dirt is expelled, is large.

Figure 22:
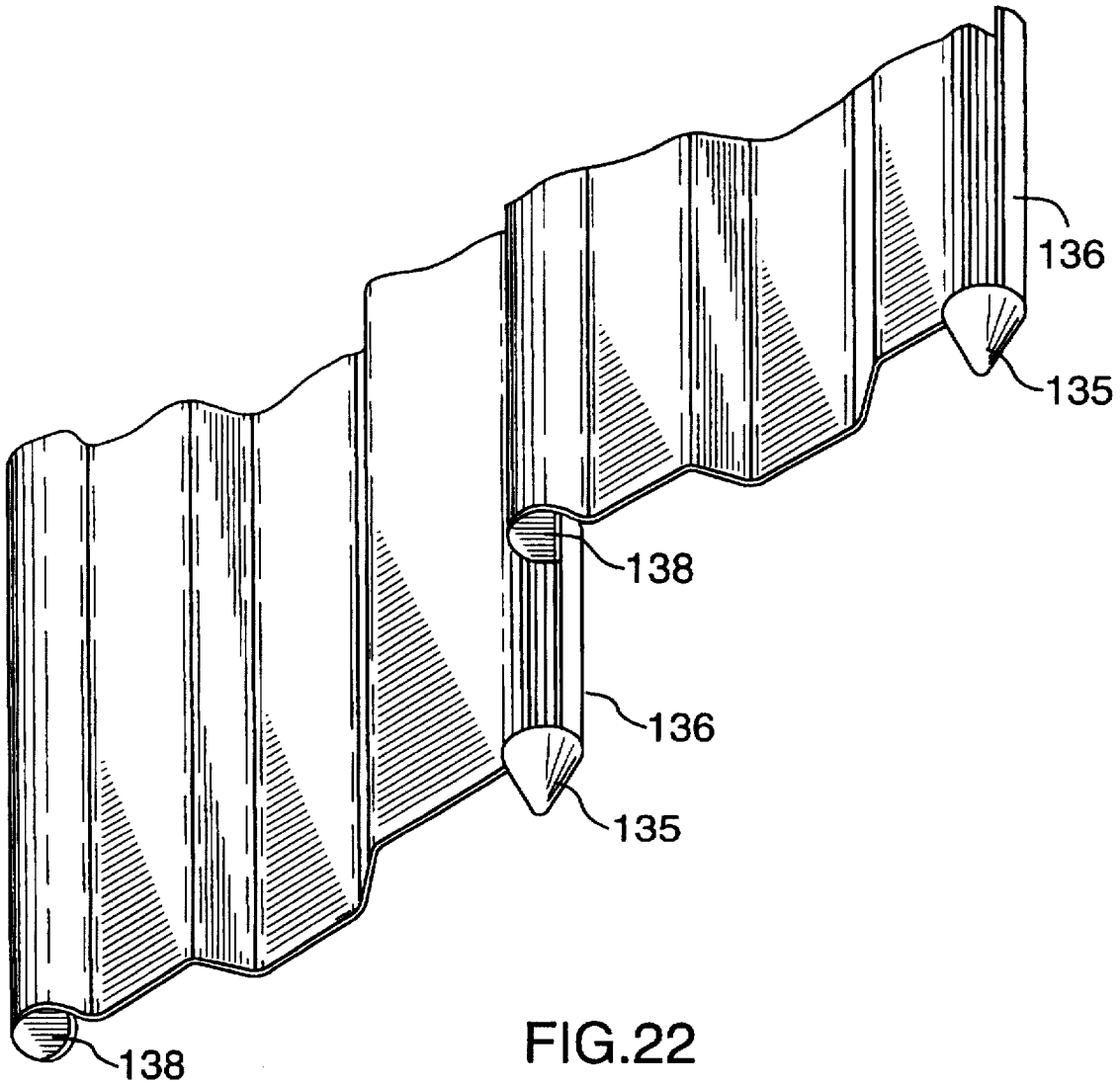
FIG. 22 is a pictorial view from underneath a pair of inter-engaging elements.

However, in cases where it is less preferred to provide a large gap in the senior edge-form, as shown in FIG. 22 a cap can be provided underneath the senior. (The cap provided underneath the senior is in addition to the scraper provided underneath the junior.)

The presence of the cap 135 underneath the senior edge-form 136, means that any dirt present inside the cavity when the junior is being driven into the cavity, is dirt that has entered, not through the open bottom of the cavity (which is closed by the cap 135), but is dirt that has entered laterally through the open gap in the side of the senior. Dirt that has entered the cavity laterally, through the circumferential gap, is less likely to be tightly packed than dirt that has been pressed into the cavity from below. Therefore, in FIG. 22, the effect of the cap 135 underneath the senior edge-form is that the dirt contained in the senior edge-form, after driving the senior edge-form, is dirt that is more likely to be loose enough to be easily driven out of the cavity by the action of the scraper 138 attached to the foot of the junior edge-form.

In effecting the present invention, the elements are made of suitable material which can survive driving into the ground. In some cases, the elements need not be of steel; the elements can be of aluminum, for example, or even plastic, in cases where the ground is suitably soft, and the depth of the barrier is fairly shallow. It is easy to produce profiled shapes in these materials, by extrusion. Steel profiles cannot, as a matter of economic practice, be shaped by extrusion, but must be rolled.

As mentioned in relation to FIG. 16, when the elements are of cold-rolled steel, the enclosure for the cavity may be provided by welding a suitable steel angle-section onto the side of one of the elements (preferably the junior). The benefit of this is that suitable interlocking profiles of cold-rolled elements (and suitable angle-sections) are available commercially on an off-the-shelf basis.

Figure 23:
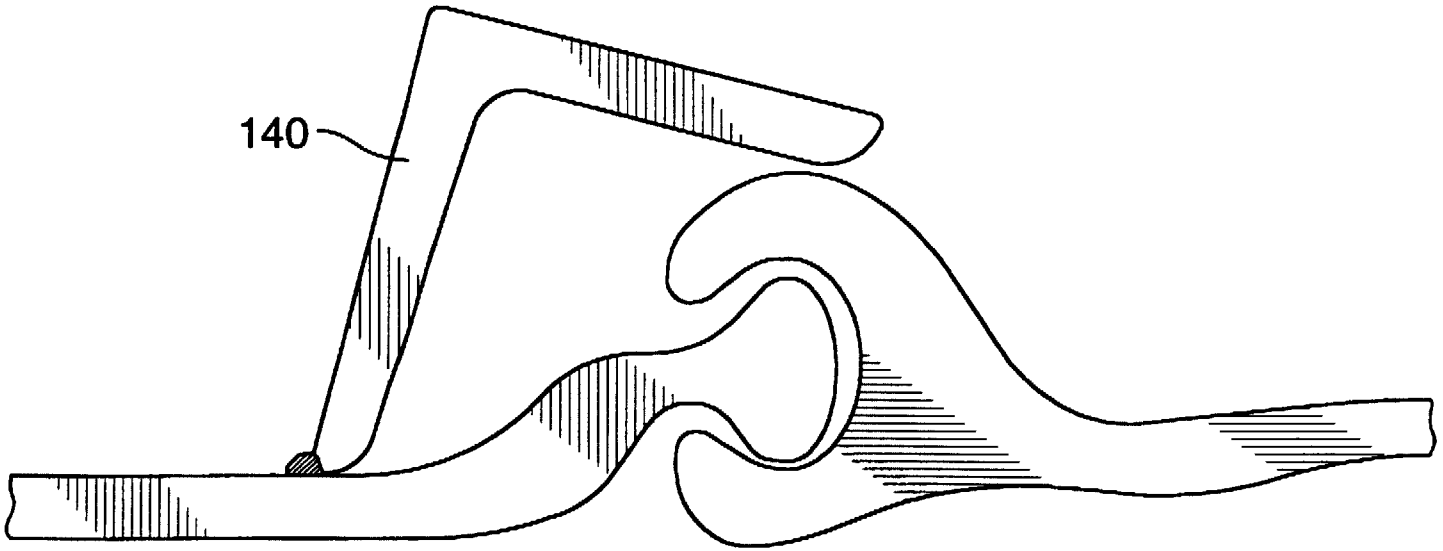
FIG. 23 is a plan view of an inter-engagement between two elements.

The same point may be made in relation to hot-rolled steel sections. Hot-rolled sections are available in off-the-shelf profiles, but the off-the-shelf profiles do not include large cavities; and again, the enclosure for defining the cavity may be formed by welding on a suitable angle-section. FIG. 23 shows a pair of interlocking hot-rolled sections, having a type of profile that is generally available off-the-shelf commercially, together with a suitable welded-on angle-section 140.

The profiles of the elements, for use in the invention, should be such as to form, when driven together, an enclosure which defines a large cavity; and should be such as to form, when driven together, a means, termed a dovetail means, for holding the cavity to a constant shape and size, i.e where the elements are constrained neither to approach nor to separate in a manner which would affect the shape and size of the cavity.

The profiles should be such that the elements are a loose enough fit upon each other that the fit does not interfere with driving. For ease of driving, the profiles should not be sprung together.

As described, a key benefit of providing the large cavity is that the cavity can be flushed out clean and clear from top to bottom, thus creating a very advantageous receptacle for the sealant. Another benefit of having a cavity which is clean and clear from top to bottom is that the cavity can be inspected. Not only that, but the inspection may be recorded, and the records may be produced as evidence for the benefit of a tribunal in a case where, for example, leakage of toxic materials into groundwater might be in issue.

The inspection may be done by means of a suitable probe. In some cases, it is sufficient for the engineer to report that he passed a simple measuring stick into the cavity, and it reached a depth of X meters. A typical installed barrier contains hundreds of joints, and the engineer would record the depth X for each joint.

The probe may be a more sophisticated instrument than a simple measuring stick. For example, the probe may comprise a video camera. The record would then be a video recording of the probe travelling from top to bottom of the cavity, and the video would make it clear that the cavity was open all the way down. It is not practical to detect directly whether the joints are fully and effectively sealed, but the tribunal could then be sure the joints had at least the potential to be fully sealed.

Even in cases where integrity of sealing might not be so important, it can be useful to run a video camera clown the joint. For example, it can sometimes happen that elements might strike a boulder below ground, and, under continued heavy driving blows, the elements then can become distorted, with the result that the edge-forms can be pried apart. When this happens, not only is the cavity lost, and impossible to seal, but the integrity of the barrier as a mechanical structure is also lost.

Such destruction of the cavity, although all-too-easy to miss by other inspection methods, is easily picked up by video.

Not much can be done about elements that have been forced apart by unforeseen boulders below ground; usually, there is no alternative but to remove the elements, break up the boulder (e.g by drilling) and then insert fresh elements. For this reason, the flushing-out of the cavities, and the video-inspection of the cavities, should be done immediately after driving, so that the equipment is still within reach if it should be necessary to take elements out.

One of the benefits of providing the scraper is that the dirt residing in the cavity before flushing starts is likely to be of such a light nature that the dirt can be easily and quickly removed by flushing. The time taken to flush a joint, until the water runs clean, is typically about a minute or so, and the video inspection takes only a few moments more. The injection of the sealant, and the subsequent setting or curing of the sealant, of course takes a much longer time, but that does not matter.

It has been mentioned that the cavity should be large enough that the circle that can be inscribed in the cavity, clear if the walls of the enclosure, is at least ¾ inch (18 mm) in diameter. A cavity of this size allows conventional half-inch reinforced-hard-rubber or plastic hose to be inserted into the cavity, whilst leaving enough room around the hose to allow particles of dirt to be expelled from the cavity.

The cavity could be smaller, if a smaller hose were used. If the ground is soft, and if the barrier is shallow, it may be possible to use a smaller hose.

In the case where a conventional three-eighths-inch hose is used, the inscribed circle should be about 12 mm (½ inch) in diameter.

The reason for the preference of a larger hose is that the volume of water delivered by the hose is then easily made large enough to sweep the pebbles all the way up the cavity, around the hose, and out at the surface. Also, it can sometimes happen that particles in the cavity can become consolidated, especially if the cavity is left for some time before being cleaned: in this case, it is helpful to be able to poke at the consolidated material mechanically with the end of the hose, which helps to break up the material into small particles that can be swept away—and the thicker the hose, the greater the effect of such mechanical manipulation. Also, the smaller the cavity, the more prone it is to becoming bridged (and blocked) by consolidation of particulate material in the cavity.

From these standpoints, it is suggested that the half-inch hose, and the 18 mm cavity, will be found adequate in substantially all cases. The three-eighths-inch hose will be found adequate in the less demanding cases, especially where the soil has a uniformly small particle size, with little likelihood of bridging.

It is contemplated that cavities of diameter even smaller than this could be cleaned out using the techniques as described, in particular special cases.

If dirt should become consolidated, or bridged, within the enclosure, and cannot be moved by the flushing water, another Way is suggested by means of which the dirt may be dislodged. Given that the element has been driven into the ground by a vibratory pile-driver, the vibrating head may be recouped to one or other of the elements at the offending joint. The vibration, coupled with flushing, may then be expected to break up even material that has become packed and caked hard inside the cavity.

Figure 24:
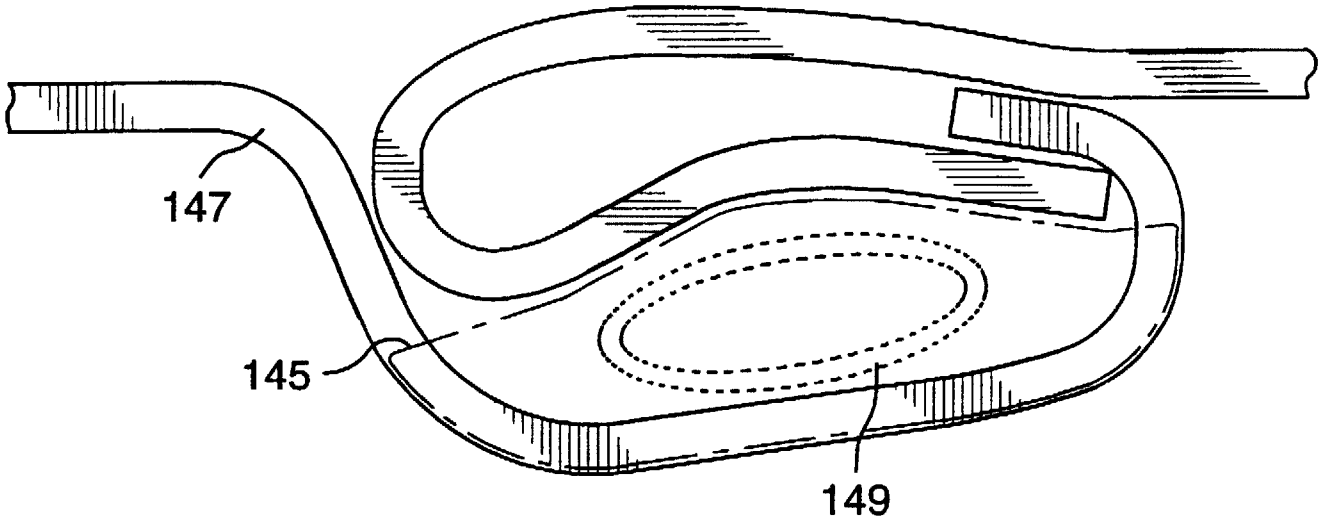
FIG. 24 is a plan view of an inter-engagement between two elements.

The cavity has been defined as to the diameter of its inscribed circle. However, it is contemplated that the cavity could be of a different shape, especially if the flushing hose is specially made to suit that different shape. As mentioned, some types of sealant do not perform well when required to fill a large bulk, and in such a case it may be preferred that the cavity be of a long-by-narrow shape, rather than circular. FIG. 24 illustrates such a shape. A scraper 145 is provided at the foot of the junior edge-form 147. The cross-sectional shape of the flushing hose is indicated at 149.

The hose 149 is elliptical, and the shape of the cavity 148 also may be characterised as being generally elliptical in nature. To ensure proper flushing out, the minor axis of the elliptical shape of the cavity should preferably be at least 10 mm long, and the area of the cavity should preferably be at least 300 sq mm.

Generally, following flushing out of the cavity, the cavity is left full of (clean) water. When the sealant is injected into the cavity, from the bottom up, as described, the water in the cavity is forced up out of the top of the cavity. It can sometimes be difficult for the engineer to determine whether he is drawing the sealant injection tube up the cavity at the correct speed: if the tube is raised too fast, not enough sealant is deposited in the cavity; if too slow, the sealant may start to rise around the tube, and be forced out of the top of the cavity.

In suitable cases, the problem of sensing and determining the correct speed of withdrawal of the injection tube may be addressed as follows.

Figure 25:
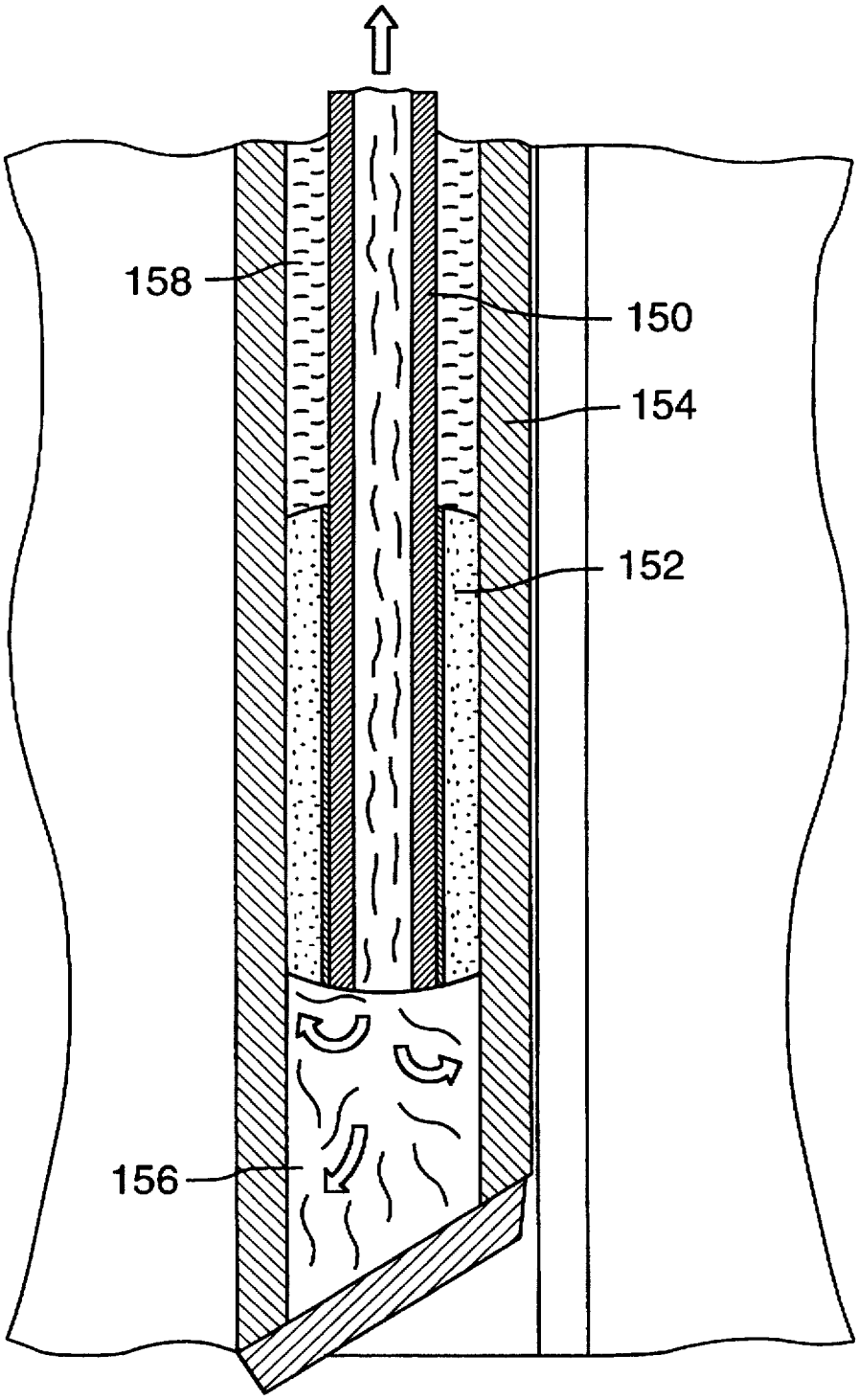
FIG. 25 is a cross-sectioned elevation of a cavity at a joint between elements.

As shown in FIG. 25, the bottom end of the sealant injection tube 150 is fitted with a collar 152. This collar is made of foam or sponge rubber, or the like, such that the collar is resiliently soft enough that the tube, with the collar in place, can be passed up and down the inside of the enclosure 154 with ease, and yet the collar serves to separate and to seal the zone 156 below the collar, and below the end of the tube 150, from the annular zone 158 above the collar.

The collar 152 can be expected to wear out over several insertions into enclosures, and should be engineered to be inexpensive to replace. Sponge rubber in itself is an inexpensive material.

In use of the collar, the tube is passed down inside the cavity, whereby the water in the cavity below the collar is displaced. The displaced water can be arranged to pass up the injection tube itself, although that will rarely be convenient. A separate tube (not shown) through the collar may be provided to convey the water displaced from below the descending collar to the surface.

Given that the cavity is not sealed at this time, water from the ground will seep into the cavity, i.e into the zone 158 above the collar.

When the tube 150, with its collar 152, has been lowered to the bottom of the cavity, the sealant is then injected through the tube. The sealant fills the volume of the zone 156 below the collar and exerts an upward pressure on the collar. This drives the collar upwards, whereby the collar rises on the ascending level of injected sealant.

A substantial advantage of the collar is that, if there should be a place in the cavity where, as the collar rises, sealant can escape out of the cavity and into the surrounding soil, the collar will automatically slow its rate of ascent to cater for that. Detecting such spurious leakage of sealant out of the cavity by other means is very difficult.

Another advantage of the collar is that the pressure it takes to force the collar up the tube is not zero, and the sealant must be under this pressure in order to be injected. Having the sealant under at least small pressure after emerging from the tube is useful for forcing the sealant into the nooks and crannies of the cavity.

The collar may be engineered to be inflatable, whereby the collar would be lowered down into the cavity in the deflated state, which would save on abrasive wear of the collar. However, the collar would still have to be dragged and rubbed, when inflated, over the inside surface of the cavity. Soft sponge rubber is preferred, from the standpoint of being cheap to replace.

The collar need not be a perfect seal inside the cavity, in that some leakage of the sealant into the zone 158 above the collar can be tolerated. In any case, the collar can be made long enough as to its vertical length to provide an adequate seal in most cases.

The surface finish of the steel, whether hot or cold-rolled, on the inside of the enclosure is generally smooth, and is unlikely to be so rough as to tear the foam rubber collar, at least not immediately. However, in the case where the cavity is formed, in part, by a welded-on angle-section, weld splashes are likely to provide sharp or rough edges such that the use of the collar would not be preferred in that case.

The scraper welded to the foot of the edge-form of the junior element has been described above. The scraper serves to make sure that any particles of dirt that may be present in the cavity, alter driving, must be small. The scraper has been described as a flat plate, which is strongly enough attached to the junior, and tough enough in itself, to survive driving.

Figure 26:
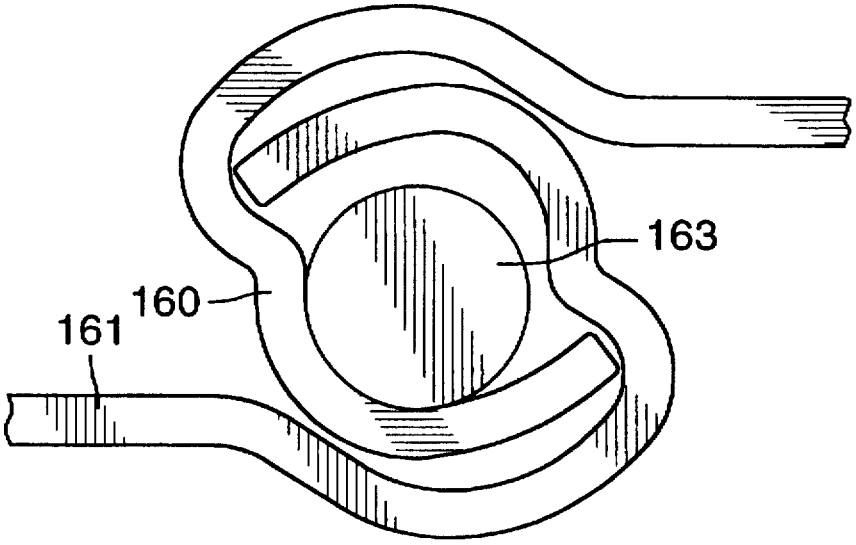
FIG. 26 is a plan view of an inter-engagement between two elements.

An alternative way of arranging for the dirt-excluding action is to provide a rod inside the cavity. The rod is attached to, and carried down with, the element during driving, and is later removed. FIG. 26 is a cross-section of senior 160 and junior 161 edge-forms interlocked to form a cavity, in which such a rod 163 is provided. The rod 163 is of steel, and is attached to the senior element 160 prior to driving. The manner of attachment is such that the rod is attached firmly enough that the rod is driven down in unison with the element, and yet the rod is afterwards detachable from the element.

Figure 27:
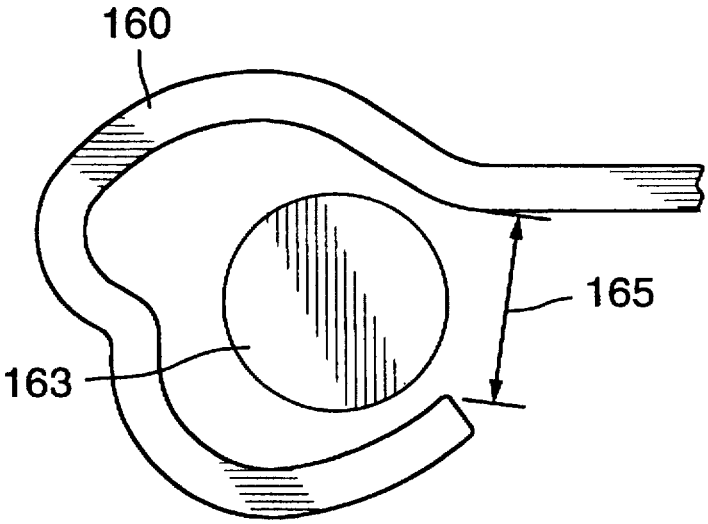
FIG. 27 is the same view as FIG. 26, with a component removed.

The rod 163 is of a small enough diameter that the presence of the rod does not interfere with the interlocking action between the senior and junior edge-forms; on the other hand, the rod is large enough, not only in order to be strong enough to stand up to the rigours of driving, but also in order that the rod 163 cannot wander or escape laterally from the cavity, through the gap 165 (FIG. 27), during driving. The rod may be of a circular section; but another shape of section, including a profile specially tailored to suit the particular edge-forms, may be more efficient.

As mentioned, the rod 163 is long, being of the same height as the element to which it is attached. The rod is removed after driving; unlike the previously-described scraper-plate, which is welded to the foot of the element, and of course remains so after driving.

As mentioned, the scraper-plate had to be attached to the junior edge-form, and not to the senior; the rod 163 may be attached either to the senior or to the junior edge-form.

As mentioned, preferably the rod should be confined laterally by being inside an edge-form profile in which the circumferential gap in the profile is smaller than the diameter of the rod, and therefore, if the senior and junior edge-forms have unequal profiles, the rod should be attached to the profile that has the smaller circumferential gap.

Although the rod is preferably hard, the rod may be of a material which is resiliently deflectable, at least in the lateral direction. Then, the rod can be arranged to fill more of the cavity, and if the oncoming junior edge-form should encroach into the space taken by the rod, the rod may deflect away.

The purpose of the rod is to fill the cavity as much as possible, whereby, when the rod is removed, the cavity is as empty (of dirt) as possible. It is intended, as with the scraper-plate, that the cavity be finally cleaned by flushing out with a hose.

Figure 28:
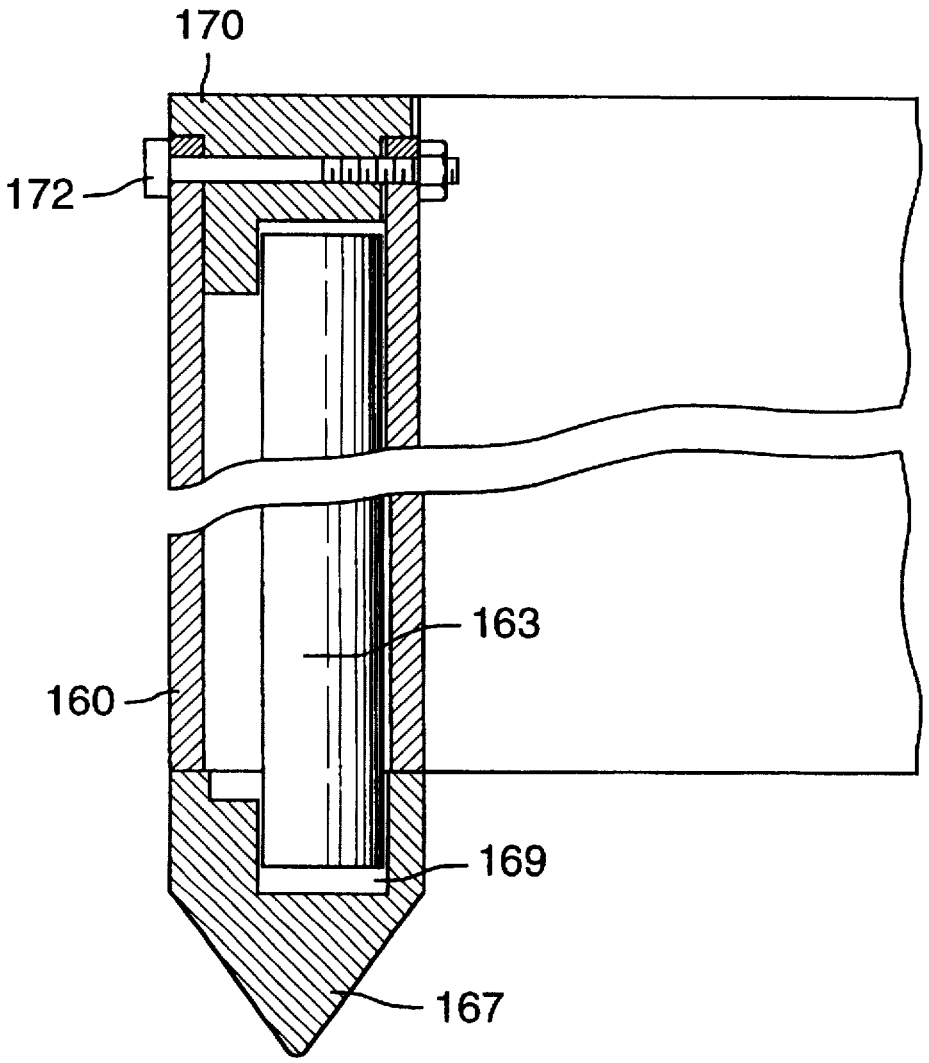
FIG. 28 is a cross-sectioned elevation of a cavity at a joint between elements.

As shown in FIG. 28, a cap 167 is welded underneath the senior edge-form 160. The cap 167 is right-conical in form. The cap is provided with a socket 169 for receiving the bottom end of the rod 163.

Similarly, at the top end, a cover 170 is secured by bolts 172 to the senior edge-form 160. The cover 170 has a socket for receiving the top end of the rod 163, as shown in FIG. 28.

Prior to commencing driving, the rod 163 is inserted in the senior cavity, and is located in the sockets, and the cover 170 is bolted to the top of the senior edge-form.

The senior edge-form is driven down, and the junior edge form on the adjoining element is driven down afterwards, with the rod still in place. In this case, no scraper is provided at the foot of the junior edge-form.

After driving of both elements is completed, the cover 170 is removed, and the rod 163 is drawn upwards and out of the cavity. As a result of this operation, the cavity can be as free and clear of dirt and debris as if the scraper as described previously had been used. The cavity is clear enough to allow the passage of a hose right down to the bottom, and the cavity can be flushed out with water as described previously.

In fact, the rod may be hollow, in which case the rod itself may serve as the hose, for conveying the flushing-out water.

When the rod is hollow, the rod may be provided with spray-holes, through the walls of the rod, whereby water can be sprayed out of the rod at various points along the length (height) of the rod. This can be used to maintain a constant spray of water to prevent dirt and debris from entering the cavity, over the whole height of the cavity. The spray may even be maintained during driving.

I claim:

1. Procedure for making an in-ground barrier, wherein:

the procedure includes the step of providing adjoining barrier elements, each element comprising a length of sheet material of uniform cross-sectional shape when viewed in plan, the elements being arranged edge to edge;

the procedure includes the step of inserting the elements into the ground;

the cross-sectional shape of each element, when viewed in plan, has a left edge-form and a right edge-form;

the barrier is of the type wherein, when the barrier is installed in the ground, the left edge-form of a senior element is in operative engagement with the right edge-form of the adjoining junior element;

the said operatively engaging left and right edge-forms overlap and interlock together to form, when viewed in plan, the circumference of an enclosure, which defines a cavity;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

the said inscribed circle is clear and unobstructed, in that, when viewed in plan, none of the material of either element encroaches within the inscribed circle;

the edge-forms of the elements are so shaped that the said inscribed circle within the enclosure is clear and unobstructed over the height of the enclosure;

the said senior and junior elements are provided with a mutually-interlocking dovetails means, for maintaining uniform the size and shape, when viewed in plan, of the said enclosure, both during insertion and after;

the procedure includes the step of extracting solid material from the cavity inside the enclosure, and of removing the said solid material from the cavity;

the procedure includes extracting and removing the solid material to the extent that, after removal, the cavity is substantially unobstructed by solid material, and is substantially clear and open, over the whole height of the enclosure, from top to bottom of the barrier;

the procedure includes the step of passing an inspection probe down into the cavity, where the probe is of the kind which is capable of providing an indication of the nature of the walls of the enclosure, being an indication which is readable from outside of the cavity and wherein the procedure includes the step of passing the inspection probe down into the cavity, from the ground surface, substantially down to the foot of the junior element.

2. Procedure of claim 1, wherein the procedure includes the step of then withdrawing the probe up and out of the cavity.

3. Procedure of claim 1, wherein:

the step of extracting the solid material from the cavity includes passing a hose-pipe down into the cavity, substantially to the foot thereof, and flushing the solid material out;

and the procedure includes the step of so flushing out substantially all the cavities in the barrier.

4. Procedure of claim 3, wherein the probe is a video camera, and the procedure includes the step of passing the video camera from top to bottom of each cavity in turn, and of making video recordings of the walls of those cavities, and of keeping same as a record of the status of the walls of the cavities prior to the cavities being sealed.

5. Procedure of claim 1, wherein the procedure includes the subsequent step, after the solid material has been extracted from the cavities, and the cavities have been inspected by the probe, of injecting sealant into the cleaned and inspected cavities.

6. Procedure for making an in-ground barrier, wherein:

the procedure includes the step of providing adjoining barrier elements, each element comprising a length of sheet material of uniform cross-sectional shape when viewed in plan, the elements being arranged edge to edge;

the procedure includes the step of inserting the elements into the ground;

the cross-sectional shape of each element, when viewed in plan, has a left edge-form and a right edge-form;

the barrier is of the type wherein, when the barrier is installed in the ground, the left edge-form of a senior element is in operative engagement with the right edge-form of the adjoining junior element;

the said operatively engaging left and right edge-forms overlap and interlock together to form, when viewed in plan, the circumference of an enclosure, which defines a cavity;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

the said inscribed circle is clear and unobstructed, in that, when viewed in plan, none of the material of either element encroaches within the inscribed circle;

the edge-forms of the elements are so shaped that the said inscribed circle within the enclosure is clear and unobstructed over the height of the enclosure;

the said senior and junior elements are provided with a mutually-interlocking dovetail means, for maintaining uniform the size and shape, when viewed in plan, of the said enclosure, both during insertion and after;

the procedure includes the step of extracting solid material from the cavity inside the enclosure, and of removing the said solid material from the cavity;

the procedure includes extracting and removing the solid material to the extent that, after removal, the cavity is substantially unobstructed by solid material, and is substantially clear and open, over the whole height of the enclosure, from top to bottom of the barrier;

the procedure includes the step, after the cavity is flushed clean and clear, of sealing the cavity, in that:

the procedure includes inserting a rod from the surface down into the cavity;

the rod is coated with a sealant material, being sealant material of the type that expands after being placed in the cavity;

the procedure includes leaving the rod in the cavity, whereby the sealant expands, and fills and seals the cavity, substantially from top to bottom.

7. Procedure for making an in-ground barrier, wherein:

the procedure includes the step of providing adjoining barrier elements, each element comprising a length of sheet material of uniform cross-sectional shape when viewed in plan, the elements being arranged edge to edge;

the procedure includes the step of inserting the elements into the ground;

the cross-sectional shape of each element, when viewed in plan, has a left edge-form and a right edge-form;

the barrier is of the type wherein, when the barrier is installed in the ground, the left edge-form of a senior element is in operative engagement with the right edge-form of the adjoining junior element;

the said operatively engaging left and right edge-forms overlap and interlock together to form, when viewed in plan, the circumference of an enclosure, which defines a cavity;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap and interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

the said inscribed circle is clear and unobstructed, in that, when viewed in plan, none of the material of either element encroaches within the inscribed circle;

the edge-forms of the elements are so shaped that the said inscribed circle within the enclosure is clear and unobstructed over the height of the enclosure;

the said senior and junior elements are provided with a mutually-interlocking dovetail means, for maintaining uniform the size and shape, when viewed in plan, of the said enclosure, both during insertion and after;

the procedure includes the step of extracting solid material from the cavity inside the enclosure, and of removing the said solid material from the cavity;

the procedure includes extracting and removing the solid material to the extent that, after removal, the cavity is substantially unobstructed by solid material, and is substantially clear and open, over the whole height of the enclosure, from top to bottom of the barrier;

the procedure includes the step, after the cavity is flushed clean and clear, of sealing the cavity, in that:

the procedure includes providing an inflatable packer, which comprises an outer sleeve of flexible material and a central core;

the procedure includes inserting the packer, from the ground surface, down into the cavity;

the arrangement of the packer is such that the outer sleeve can be deflated onto the central core for installing the packer in the cavity, and the packer can be inflated from the surface;

the procedure includes the step, after the packer is installed in the cavity, of inflating the packer, to seal the outer sleeve into the cavity.

8. Procedure of claim 7, wherein the packer is of such length as to occupy substantially the whole height or depth of the cavity.

9. Procedure of claim 7, wherein the packer is short in length, and the core is hollow;

and the procedure includes lowering the packer to a particular depth in the cavity, and then inflating the packer, whereby the packer seals the cavity at that depth;

and the procedure includes the step of injecting sealant through the hollow core into the region of the cavity below the packer.

10. Procedure of claim 9, wherein the procedure includes deflating the packer, raising the packer to another position in the cavity, re-inflating the packer, and then again injecting sealant into the region of the cavity below the packer.

11. In-ground barrier apparatus, wherein:

the apparatus includes adjoining ground-insertable barrier elements, each element comprising a length of sheet material of uniform cross-sectional shape when viewed in plan, the elements being arranged edge to edge;

the cross-sectional shape of each element, when viewed in plan, has a left edge-form and a right edge-form;

the barrier is of the type wherein, when the barrier is installed in the ground, the left edge-form of a senior element is in operative engagement with the right edge-form of the adjoining junior element;

the said operatively engaging left and right edge-forms overlap and interlock together to form, when viewed in plan, the circumference of an enclosure, which defines a cavity;

one portion, termed the senior portion, of the circumference of the enclosure, being less than the whole circumference of the enclosure is constituted by a portion of the right edge-form of the senior element, and another portion of the circumference of the enclosure, termed the junior portion, being also less than the whole circumference of the enclosure is constituted by a portion of the left edge-form of the junior element;

whereby the circumference of the enclosure is inherently not watertight, in that potential leakage paths exist between the senior and junior portions of the circumference of the enclosure;

the senior and junior portions of the circumference of the enclosure overlap end interlock in such a manner that each and every leakage path starting from in front of the barrier and finishing behind the barrier is in communication with the said cavity;

the shape and size of the said enclosure, when viewed in plan, is such that a circle inscribed within the cavity has a substantial diameter;

the said inscribed circle is clear and unobstructed, in that, when viewed in plan, none of the material of either element encroaches within the inscribed circle;

the edge-forms of the elements are so shaped that the said inscribed circle within the enclosure is clear and unobstructed over the height of the enclosure;

the said senior and junior elements are provided with a mutually-interlocking dovetail means, for maintaining uniform the size and shape, when viewed in plan, of the said enclosure, both during insertion and after;

the apparatus includes a means for preventing the ingress of solid material into the cavity inside the enclosure;

whereby, in the barrier apparatus, after installation in the ground, the solid material is excluded from the cavity to the extent that, after removal, the cavity is substantially unobstructed by solid material, and is substantially clear and open, over the whole length height of the enclosure, from top to bottom of the barrier;

the means for preventing the ingress of solid material into the cavity comprises a rod;

the rod is of such cross-sectional dimensions as to occupy a major portion of the cross-sectional area of the cavity;

the rod is of such length as to occupy substantially the whole height the cavity;

the rod is secured inside one of the edge-form profiles comprising the enclosure;

the rod is detachably secured to the said profile, whereby the rod can be detached from the profile, after the barrier is installed in the ground;

the arrangement of the apparatus is such that, upon being detached, the rod can be withdrawn upwards, and out of the cavity, leaving the cavity substantially clear and open from top to bottom.

12. Apparatus of claim 11, wherein the rod has a hollow interior, and is provided with outlet holes, which are so arranged that, with the rod in place inside the cavity, in the installed barrier, a liquid can be pumped into the hollow interior of the rod, and out of the outlet holes, into the cavity;

the apparatus is so arranged that such liquid can pass out of the top of the cavity, at the ground surface;

whereby particles of solid material that may have entered the cavity during installation can be flushed out.

13. Apparatus of claim 11, wherein the apparatus includes a composite element, formed from two of the said elements assembled together, and tack-welded together, with adjacent edge-forms interlocking, whereby the interlocking edge-forms constitute one of the said enclosures;

whereby the composite element can be driven into the ground as an integral unit;

and wherein the composite element includes a cap welded to the foot of the enclosure, which is so dimensioned and arranged as to substantially prevent dirt and soil from entering the cavity defined by the enclosure.

14. Apparatus of claim 11, wherein:

the element includes an angle section that is tack-welded to the sheet material of the element;

the angle-section extends over substantially the whole height of the element;

the portions of the profiles of the adjacent elements that define the mutually-interlocking dovetail means are termed the dovetail portions;

the portions of the profiles of the adjacent elements that define the enclosure are termed the enclosure portions;

the dovetail portions are separate from and spaced from the enclosure portions;

and the angle section is included in the enclosure portion.

* * * * *